US008980514B2

(12) United States Patent
Nakayama et al.

(10) Patent No.: US 8,980,514 B2
(45) Date of Patent: Mar. 17, 2015

(54) TONER FOR ELECTROSTATIC LATENT IMAGE DEVELOPMENT

(71) Applicant: KYOCERA Document Solutions Inc., Osaka-shi (JP)

(72) Inventors: Yukinori Nakayama, Osaka (JP); Hiroaki Moriyama, Osaka (JP); Takeo Mizobe, Osaka (JP); Takanori Tanaka, Osaka (JP); Hiroki Uemura, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 13/950,124

(22) Filed: Jul. 24, 2013

(65) Prior Publication Data

US 2014/0030649 A1 Jan. 30, 2014

(30) Foreign Application Priority Data

Jul. 26, 2012 (JP) ..... 2012-166397
Jul. 26, 2012 (JP) ..... 2012-166398
May 22, 2013 (JP) ..... 2013-108102

(51) Int. Cl.
*G03G 9/093* (2006.01)

(52) U.S. Cl.
CPC ..... *G03G 9/093* (2013.01); *G03G 9/09307* (2013.01); *G03G 9/09314* (2013.01); *G03G 9/09321* (2013.01); *G03G 9/09392* (2013.01)
USPC ..... 430/110.1; 430/110.2

(58) Field of Classification Search
USPC ..... 430/110.1, 110.2
See application file for complete search history.

(56) References Cited

U.S. PATENT DOCUMENTS 5,981,129 A * 11/1999 Akazawa et al. ..... 430/110.2
2006/0210899 A1* 9/2006 Nakazawa et al. ..... 430/106.1
2007/0042285 A1* 2/2007 Kitani et al. ..... 430/110.2
2008/0166156 A1* 7/2008 Kawase ..... 399/222
2008/0226997 A1 9/2008 Nakamura et al.
2009/0130589 A1* 5/2009 Udo et al. ..... 430/137.11
2009/0220883 A1 9/2009 Sugiura
2009/0297225 A1* 12/2009 Yamada et al. ..... 399/252
2010/0266947 A1* 10/2010 Maezawa ..... 430/110.2
2011/0053071 A1 3/2011 Miki et al.

(Continued)

FOREIGN PATENT DOCUMENTS

JP 2002-148852 A 5/2002
JP 2011-070179 A 4/2011

(Continued)

OTHER PUBLICATIONS

Extended European Search issued Nov. 8, 2013 in corresponding application No. 13177832.6.
Notice of Reasons for Rejection issued to corresponding JP Application No. 2012-166398, mailed Aug. 12, 2014.

*Primary Examiner* — Hoa V Le
(74) *Attorney, Agent, or Firm* — Knobbe Martens Olson & Bear LLP

(57) ABSTRACT

A toner for electrostatic latent image development is comprised toner particles containing toner core particle containing at least a binder resin and a shell layer coating the toner core particle. The shell layer is smoothened to a predetermined level. And, when cross-sections of the toner particles are observed using a transmission electron microscope, cracks approximately perpendicular to surfaces of the toner core particles are observable inside the shell layer.

7 Claims, 6 Drawing Sheets

(56) References Cited

U.S. PATENT DOCUMENTS

| | | | | |
|---|---|---|---|---|
| 2011/0281209 | A1 | 11/2011 | Sugiura et al. | |
| 2011/0305984 | A1 * | 12/2011 | Tominaga et al. | 430/108.4 |
| 2013/0236828 | A1 | 9/2013 | Mizoguchi et al. | |

FOREIGN PATENT DOCUMENTS

| | | | |
|---|---|---|---|
| JP | 2012-137717 | A | 7/2012 |
| WO | 2012/070389 | A1 | 5/2012 |

* cited by examiner

TONER FOR ELECTROSTATIC LATENT IMAGE DEVELOPMENT

INCORPORATION BY REFERENCE

This application is based upon and claims the benefit of priority from the corresponding Japanese Patent Application Nos. 2012-166397, 2012-166398 and 2013-108102 respectively filed in the Japan Patent Office on Jul. 26, 2012, Jul. 26, 2012, and May 22, 2013, the entire contents of which are incorporated herein by reference.

FIELD

The present disclosure relates to a toner for electrostatic latent image development.

BACKGROUND

In electrophotography, generally, a surface of a latent image bearing member is charged using a process such as corona discharge followed by exposure using laser to form an electrostatic latent image. The resulting electrostatic latent image is developed by a toner to form a toner image. An image with high quality can be obtained by transferring the resulting toner image on a recording medium. Typically, toner particles (toner base particles) with an average particle diameter of from 5 μm to 10 μm, produced by mixing a binder resin such as a thermoplastic resin with toner components such as a colorant, a charge control agent, a release agent, and a magnetic material and then passing the mixture through the steps of kneading, pulverizing, and classifying, are used for the toner applied to such electrophotography. In addition, in order to provide flowability or appropriate charging performance to the toner or to facilitate cleaning of the toner from surfaces of photoconductor drums, silica and/or inorganic fine particles such as those of titanium oxide are externally added to the toner base particles.

In regards to such a toner, for the purpose of improving low-temperature fixability, improving high-temperature storage stability, and improving blocking resistance, toner, which includes toner particles of a core-shell structure in which toner core particles using a binder resin of a lower melting point are coated with a shell material consisting of a resin with a glass transition point (Tg) higher than that of the binder resin in the toner core particles, have been used heretofore.

As for toner which includes toner particles with such a core-shell structure, a toner which includes toner particles with a core-shell structure, composed of toner core particles containing a polyester resin or a resin where a polyester resin and a vinyl resin are bound and a shell layer consisting of a shell material containing a copolymer between styrene and a (meth)acrylic monomer containing a polyalkylene oxide unit, has been proposed. The toner particles with this core-shell structure are formed by coating a surface of toner core particles with resin fine particles dispersed in an aqueous medium in the presence of an organic solvent such as ethyl acetate.

However, in the shell layers of the toner particles in the toner, since contact sites of the resin fine particles themselves have been dissolved by the organic solvent, there remains almost no void between the resin fine particles and uniform films are formed in a condition that the shape of resin fine particles remains. Therefore, when forming images using the toner, the shell layer may be resistant to break during fixing images on recording media even when a pressure is applied to the toner particles in the toner. In cases where the shell layer cannot be easily broken, it is difficult to appropriately fix the toner on recording media.

SUMMARY

A toner for electrostatic latent image development of the present disclosure is comprised toner particles containing a toner core particle containing at least a binder resin and a shell layer coating the toner core particle. The shell layer is formed using spherical resin fine particles. When surfaces of the toner particles are observed with respect to toner particles having a particle diameter from 6 μm to 8 μm using a scanning electron microscope, structures derived from the spherical resin fine particles are unobservable at the shell layers. And, when cross-sections of the toner particles are observed using a transmission electron microscope, cracks are observable inside the shell layer in which the cracks are approximately perpendicular to surfaces of the toner core particles and originate at phase boundaries of the resin fine particles themselves.

DETAILED DESCRIPTION

The present disclosure is explained in detail with respect to embodiments thereof below; however, the present disclosure is not limited at all to the embodiments and may be carried out with appropriately making a change within the purpose of the present disclosure. In addition, explanation may be occasionally omitted with respect to duplicated matters; this does not however limit the gist of the present disclosure.

The toner for electrostatic latent image development of the present disclosure (hereinafter, also merely referred to as "toner") includes toner particles and the toner particle is composed of toner core particle containing at least a binder resin and a shell layer coating the toner core particle. The shell layer coating the toner core particle is formed using spherical resin fine particles.

When the surfaces of the toner particles are observed with respect to toner particles having a particle diameter from 6 μm to 8 μm using a scanning electron microscope, the structures derived from the spherical resin fine particles are unobservable on the surfaces of the shell layers. When the cross-sections of the toner particles are observed using a transmission electron microscope, cracks are observable inside the shell layers in which the cracks are approximately perpendicular to surfaces of the toner core particles and originate at phase boundaries of the resin fine particles themselves. Hereinafter, the structure of the toner particles and materials of the toner particles are explained.

Structure of Toner Particles

Figure 1:
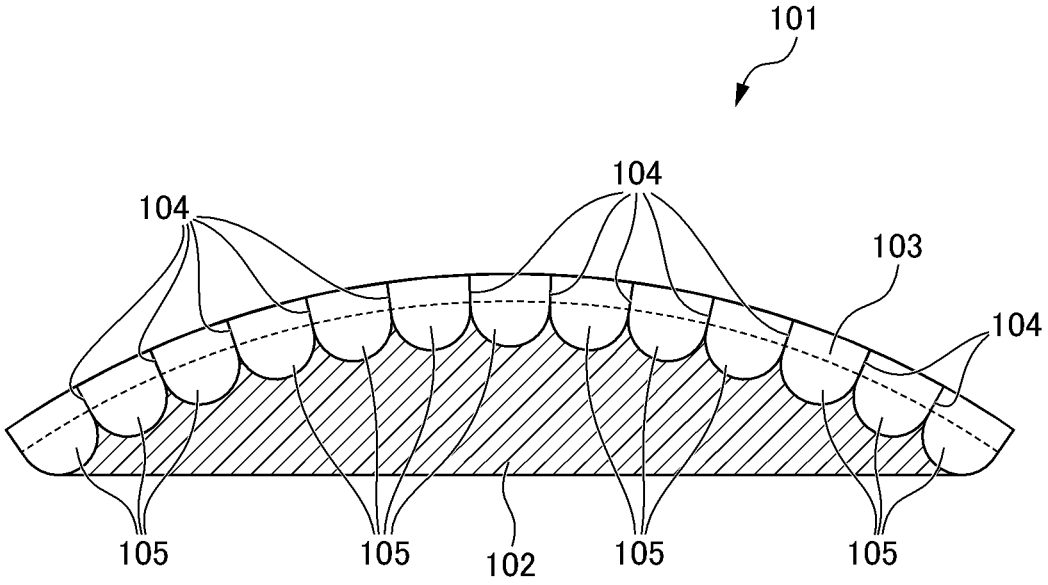
FIG. 1 is a view showing a partial cross-section of the toner particle in the toner of the present disclosure.

In the toner particles in the toner of the present disclosure, the entire surfaces of the toner core particles are coated with the shell layers. Surface conditions of the toner particles coated with the shell layers can be confirmed using a scanning electron microscope (SEM). Smoothened levels of the shell layers and inner structures of the shell layers of the toner particles can be confirmed by observing cross-sections of the toner particles using a transmission electron microscope (TEM). FIG. 1 shows a schematic cross-sectional view, which is observed using a TEM, of toner particle in the toner in accordance with one preferable embodiment of the present disclosure.

As shown in FIG. 1, in the toner particle 101 in the toner for electrostatic latent image development, the shell layer 103 covers the entire surface of the toner core particle 102. The shell layer is formed by smoothening an outer surface of a layer of resin fine particles, which has been formed by adhering the resin fine particles onto toner core particle, using an external force.

The thickness of the shell layer 103 is preferably from 0.03 μm to 1 μm, more preferably from 0.04 μm to 0.7 μm, particularly preferably from 0.045 μm to 0.5 μm, and most preferably from 0.045 μm to 0.3 μm. When the shell layer has convex parts, the shell layer may be uneven in its thickness, as described later. In cases where the shell layer is uneven in its thickness like this, the thickness at the thickest part of the shell layer is defined as "the thickness of the shell layer" in claims and specification of the present application.

When forming images using a toner which includes toner particles with an excessively thick shell layer, the shell layers are resistant to break even if a pressure is applied to the toner particles during fixing the toner to recording media. In this case, it is difficult to fix the toner in a low-temperature region since softening or melting of binder resins and/or release agents in toner core particles does not promptly proceed. On the other hand, an excessively thin shell layer leads to a lower strength. When the strength of the shell layer is low, the shell layer may be broken due to a shock occurring during a state like transportation. In cases where toners are stored at high temperatures, toner particles with a shell layer broken at least partially tends to agglomerate. The reason is that components such as a release agent tend to exude onto a surface of the toner particle through the site where the shell layer has been broken.

The thickness of the shell layer 103 may be measured by analyzing a TEM image of a cross-section of the toner particle 101 using commercially available image analysis software. Software such as WINROOF (by MITANI Co.) may be used as the commercially available image analysis software.

As shown in FIG. 1, preferably, the shell layer 103 has convex parts 105 between two cracks 104 on the phase boundary between the toner core particle 102 and the shell layer 103. By having such convex parts 105 in the shell layer 103, the contact area between the toner core particle 102 and the shell layer 103 is larger than that of the case where the shell layer has no convex part 105. Therefore, when the shell layer has the convex parts 105, the toner core particle 102 and the shell layer 103 appropriately adhere, and thus the shell layer 103 is unlikely to peel from the toner core particle 102. Therefore, by having the convex parts 105 in the shell layer 103, a toner with excellent heat-resistant storage stability can be obtained.

More specifically, the shell layer formed using resin fine particles is formed by a method including:

I) a step of making spherical resin fine particles adhere to the surface of toner core particle so as to not overlap in a direction perpendicular to the surface of toner core particle and forming a layer of the resin fine particles that covers the entire surface of the toner core particle, and II) a step of forming shell layer by applying an external force to the outer surface of the layer of the resin fine particles and deforming the resin fine particles in the layer of the resin fine particles to thereby smoothen the outer surface of the layer of the resin fine particles.

The smoothened level of the shell layer may be such a level that the structures derived from the spherical resin fine particles used for forming the shell layer cannot be observed at the outer surfaces of the shell layers of toner particles having a particle diameter from 6 μm to 8 μm when observing the surfaces of the toner particles using a scanning electron microscope. When the toner particles having a particle diameter from 6 μm to 8 μm represent such a condition in the shell layers, in almost all the toner particles in the toner, the shell layers have been formed such that the surfaces of the toner core particles are not exposed. In a case that the condition of outer surface of the shell layer is confirmed using the scanning electron microscope, the particle diameter of a toner particle is an equivalent circle diameter calculated from a projected area of the toner particle on an electron microscope image.

In the preferable embodiment of the shell layer shown in FIG. 1, the entire surface of the toner core particle 102 is coated by the shell layer 103. Since the shell layer 103 covers the entire surface of the toner core particle 102 such that its outer surface is smooth, components such as a release agent are unlikely to exude onto a surface of the toner particle 101 during storage of the toner particle 101 at high temperatures.

There are voids (cracks) 104 inside the shell layer 103. Therefore, when a pressure is applied to the toner for fixing the toner particles on recording media, the shell layer is likely to break from a crack as an origin. When the shell layer is promptly broken, then softening or melting of components such as a binder resin and a release agent in the toner core particles 102 promptly proceeds, thus the toner can be fixed on recording media at a temperature lower than heretofore.

In the toner of the present disclosure, the average circularity of toner particles with a primary particle diameter from 3 μm to 10 μm is preferably from 0.960 to 0.970.

Typically, in cases of producing toner particles of a toner by pulverizing processes, the toner particles tends to have an irregular shape with a low circularity. Therefore, the cases of producing a toner by pulverizing processes tend to result in toner particles with poor flowability. When forming an image using a toner which includes toner particles with a low circularity, the contact friction coefficient with a surface of latent image bearing member may increase and thus toner particles not having been transferred, may remain on the latent image bearing member after transferring the toner image on the latent image bearing member. Such a transfer residual toner is typically removed from the surface of latent image bearing member by a cleaning unit having a mechanism such as an elastic blade.

Particle diameters of toner particles in a toner are often adjusted between 5 μm and 10 μm. In many cases, toners of which the particle diameter is adjusted within this range contain fine toner particles with a particle diameter of less than 5 μm. In cases of using a toner containing such fine toner particles, when the transfer residual toner has occurred, the fine toner particles in the transfer residual toner may pass through the elastic blade of the cleaning unit. The "passing through" of the transfer residual toner in the cleaning unit may be a cause of occurrence of image defects in resulting images.

Furthermore, since the shape of toner particles obtained through pulverizing processes is nonuniform, toner particles with a high aspect ratio in cross-sectional shape (ratio of a long diameter to a short diameter) are partially included in the toner. Toner particles with a high aspect ratio tend to firmly attach on latent image bearing member at a surface in a long diameter direction. When a part of toner particles have firmly attached on latent image bearing member, in some cases, a part of toner images formed on latent image bearing member are not transferred on recording media. In such cases, an image defect called "void" occurs in resulting images. Furthermore, in cases where a toner image on a surface of latent image bearing member is transferred on an intermediate transcriptional body such as an intermediate transfer belt and then the toner image on the intermediate transcriptional body is transferred on recording media to thereby form an image, if transfer failure has occurred, an image defect called "letter scattering" (phenomenon in which a toner adheres near fixed images such as letters in a condition that the toner is scattered in transferred images) tends to occur in resulting images.

In response, in the case of the toner of the present disclosure in which the average circularity of toner particles with a primary particle diameter from 3 μm to 10 μm is from 0.960 to 0.970, the occurrence of image defects in resulting images due to passing through of the toner in cleaning units and image defects such as void and letter scattering in resulting images can be suppressed.

Toner particles with an excessively low average circularity lead to a large contact friction coefficient with latent image bearing member (photoconductor drum) due to a less roundish shape. When the contact friction coefficient between toner particles and latent image bearing member is high, the toner particles are resistant to peeling from the surface of latent image bearing member when toner images are transferred from the latent image bearing member to recording media. In such a case, image defects due to the occurrence of void during transfer tend to occur in resulting images. In cases of forming images using a toner which includes toner particles with an excessively high average circularity, the toner tends to pass through cleaning units for removing the transfer residual toner when cleaning the transfer residual toner. The passing through of the transfer residual toner in the cleaning units may be a cause of occurrence of image defects in resulting images.

The average circularity of toner particles with a particle diameter from 3 μm to 10 μm can be measured in accordance with the method below. Particles with a particle diameter less than 3 μm contain almost no toner particles, and particles with a particle diameter greater than 10 μm contain many toner particles which have formed agglomerates. For this reason, the range of particle diameters of toner particles for which the average circularity is determined is defined as the range from 3 μm to 10 μm.

Method of Measuring Average Circularity

Using a Flow Particle Image Analyzer (FPIA-3000, by Sysmex Co.), an average circularity of toner particles with a particle diameter from 3 μm to 10 μm in a toner is measured. Under an environment of 23° C. and 60% RH, a circumferential length ($L_0$) of a circle having a projected area the same as that of a particle image and a peripheral length (L) of a particle projected image are measured for all of toner particles. A circularity is calculated from the measured $L_0$ and L in accordance with the formula below. The sum of circularities of toner particles with an equivalent circle diameter from 3.0 μm to 10.0 μm is divided by a total particle number of toner particles with an equivalent circle diameter from 3.0 μm to 10.0 μm, and the resulting value is defined as the average circularity.

(Formula to Calculate Average Circularity)

$$\text{Average circularity}=L_0/L$$

Material of Toner Particles

The toner particles in the toner are composed of toner core particles containing at least a binder resin and the shell layers coating the entire surfaces of the toner core particles. The toner core particles may contain components such as a release agent, a charge control agent, a colorant, and a magnetic powder in the binder resin as required. The surface of the toner particles may be treated using an external additive as required. The toner may be mixed with a desired carrier and used as a two-component developer.

Hereinafter, the binder resin, the release agent, the charge control agent, the colorant, the magnetic powder, the resin fine particles for forming the shell layer, and external additives, which are essential or optional components to configure the toner particles, the carrier which is used in a case of using the toner as a two component developer, and a method of producing the toner particles are explained in order.

Binder Resin

The toner core particles contain a binder resin. The binder resin in the toner core particles is not particularly limited as long as it is a resin used heretofore as a binder resin for toners. Specific examples of the binder resin are thermoplastic resins such as polystyrene resins, acrylic resins, styrene-acrylic resins, polyethylene resins, polypropylene resins, vinyl chloride resins, polyester resins, polyamide resins, polyurethane resins, polyvinyl alcohol resins, vinyl ether resins, N-vinyl resins, and styrene-butadiene resins. Among these resins, polystyrene resins and polyester resins are preferable from the viewpoints of dispersibility of colorants in the binder resin, charging ability of the toner, and fixability on paper. Hereinafter, the polystyrene resin and the polyester resin are explained.

The polystyrene resin may be a styrene homopolymer or a copolymer between styrene and other copolymerization monomers copolymerizable with styrene. Specific examples of the other copolymerization monomers copolymerizable with styrene are p-chlorostyrene; vinylnaphthalene; ethylenically unsaturated monoolefins such as ethylene, propylene, butylene, and isobutylene; halogenated vinyls such as vinyl chloride, vinyl bromide, and vinyl fluoride; vinyl esters such as vinyl acetate, vinyl propionate, vinyl benzoate, and vinyl butyrate; (meth)acrylic acid esters such as methyl acrylate, ethyl acrylate, n-butyl acrylate, isobutyl acrylate, dodecyl acrylate, n-octyl acrylate, 2-chloroethyl acrylate, phenyl acrylate, α-methyl chloroacrylate, methyl methacrylate, ethyl methacrylate, and butyl methacrylate; other acrylic acid derivatives such as acrylonitrile, methacrylonitrile, and acrylamide; vinyl ethers such as vinyl methyl ether and vinyl isobutyl ether; vinyl ketones such as vinyl methyl ketone, vinyl ethyl ketone, and methyl isopropenyl ketone; and N-vinyl compounds such as N-vinyl pyrrole, N-vinyl carbazole, N-vinyl indole, and N-vinyl pyrrolidene. These copolymerization monomers may be copolymerized with styrene monomer in a combination of two or more.

The polyester resin may be those obtained through condensation polymerization or co-condensation polymerization of bivalent, trivalent or higher-valent alcohol components and bivalent, trivalent or higher-valent carboxylic acid components. The components used for synthesizing the polyester resin may be exemplified by the alcohol components and the carboxylic acid components below.

Specific examples of the divalent, trivalent or higher-valent alcohols may be exemplified by diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, and polytetramethylene glycol; bisphenols such as bisphenol A, hydrogenated bisphenol A, polyoxyethylenated bisphenol A, and polyoxypropylenated bisphenol A; and trivalent or higher-valent alcohols such as sorbitol, 1,2,3,6-hexanetetrol, 1,4-sorbitane, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Specific examples of the divalent, trivalent or higher-valent carboxylic acids include divalent carboxylic acids such as maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azealic acid, malonic acid, or alkyl or alkenyl succinic acids including n-butyl succinic acid, n-butenyl succinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, isododecenylsuccinic acid; and trivalent or higher-valent carboxylic acids such as 1,2,4-benzene tricarboxylic acid (trimellitic acid), 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylene carboxypropane, 1,2,4-cyclohexane tricarboxylic acid, tetra (methylenecarboxyl)methane, 1,2,7,8-octanetetracarboxylic acid, pyromellitic acid, and Enpol trimer. These divalent, trivalent or higher-valent carboxylic acids may be used as ester-forming derivatives such as an acid halide, an acid anhydride, and a lower alkyl ester. Here, the term "lower alkyl" means an alkyl group of from 1 to 6 carbon atoms.

When the binder resin is a polyester resin, the softening point of the polyester resin is preferably from 70° C. to 130° C. and more preferably 80° C. to 120° C.

In a case that the toner is used as a magnetic one-component developer, preferably, a resin having at least one functional group selected from the group consisting of hydroxyl group, carboxyl group, amino group, and epoxy group (glycidyl group) in its molecule is used as the binder resin. By use of the binder resin having these functional groups in its molecule, dispersibility of components such as a magnetic powder and a charge control agent in the binder resin can be improved. Presence or absence of these functional groups can be confirmed using a Fourier transform infrared spectrophotometer (FT-IR). The amount of these functional groups in the resins can be measured using conventional processes such as titration.

A thermoplastic resin is preferable as the binder resin since a toner with an appropriate fixability to paper may be easily obtained; here, the thermoplastic resin may be used together with a cross-linking agent and/or a thermosetting resin. By adding the cross-linking agent and/or the thermosetting resin and introducing a partial cross-linked structure into the binder resin, heat-resistant storage stability and durability of the toner may be improved without degrading the fixability of the toner. When a thermosetting resin is used together with the thermoplastic resin, the amount of cross-linked part (gel amount) in the binder resin extracted using a Soxhlet extractor is preferably no greater than 10% by mass and more preferably from 0.1% to 10% by mass based on the mass of the binder resin.

The thermosetting resin usable together with the thermoplastic resin is preferably epoxy resins and cyanate resins. Specific examples of preferable thermosetting resins are bisphenol A-type epoxy resins, hydrogenated bisphenol A-type epoxy resins, novolak-type epoxy resins, polyalkylene ether-type epoxy resins, cyclic aliphatic-type epoxy resins, and cyanate resins. These thermosetting resins may be used in a combination of two or more.

The glass transition point (Tg) of the binder resin is preferably from 40° C. to 70° C. A toner which includes toner particles obtained using a binder resin with an excessively high glass transition point tends to exhibit poor low-temperature fixability. A toner which includes toner particles obtained using a binder resin with an excessively low glass transition point tends to exhibit poor heat-resistant storage stability.

The glass transition point of the binder resin can be determined from a changing point of specific heat of the binder resin using a differential scanning calorimeter (DSC). More specifically, the glass transition point of the binder resin can be determined by measuring an endothermic curve using a differential scanning calorimeter (DSC-6200, by Seiko Instruments Inc.) as a measuring device. 10 mg of a sample to be measured is loaded into an aluminum pan and an empty aluminum pan is used as a reference. The glass transition point of the binder resin can be determined from an endothermic curve of the binder resin that is obtained by measuring under a measuring temperature range of from 25° C. to 200° C., a temperature-increase rate of 10° C./min, and normal temperature and normal humidity.

The mass average molecular mass (Mw) of the binder resin is preferably from 20,000 to 300,000 and more preferably from 30,000 to 200,000. The mass average molecular mass (Mw) of the binder resin can be determined using gel permeation chromatography (GPC) based on a calibration curve previously prepared using standard polystyrene resins.

When the binder resin is a polystyrene resin, preferably, the binder resin has a peak in a region of lower molecular masses and a peak in a region of higher molecular masses respectively in terms of molecular mass distribution measured by a means such as gel permeation chromatography. Specifically, the peak of molecular mass in a region of lower molecular masses is preferably within a range from 3,000 to 20,000 and the peak of molecular mass in a region of higher molecular masses is preferably within a range from 300,000 to 1,500,000. It is preferred for the polystyrene resin having such a molecular mass distribution that a ratio (Mw/Mn) of a mass average molecular mass (Mw) to a number average molecular mass (Mn) is at least 10. By use of the binder resin having a peak respectively in a region of lower molecular masses and a region of higher molecular masses, a toner excellent in low-temperature fixability and allowing to suppress high-temperature offset can be obtained.

Release Agent

The toner core particles preferably contain a release agent in order to improve fixability and offset resistance. The release agent is preferably a wax. Examples of the wax include carnauba wax, synthetic ester wax, polyethylene wax, polypropylene wax, fluorine resin wax, Fischer-Tropsch wax, paraffin wax, montan wax, and rice wax. These release agents may be used in a combination of two or more. The occurrence of offset and/or image smearing (smear around images occurring upon rubbing the images) may be more effectively suppressed by adding the release agent to the toner.

In cases where a polyester resin is used as the binder resin, preferably, at least one release agent selected from the group consisting of carnauba wax, synthetic ester wax, and polyethylene wax is used from the viewpoint of compatibility between the binder resin and the release agent. In cases where a polystyrene resin is used as the binder resin, preferably, Fischer-Tropsch wax and/or paraffin wax is used similarly from the viewpoint of compatibility between the binder resin and the release agent.

The Fischer-Tropsch wax is a linear hydrocarbon compound, produced by Fischer-Tropsch reaction of a catalytic hydrogenation reaction of carbon monoxide, which has a small content of iso-structural molecules and/or side chains.

Among Fischer-Tropsch waxes, those having a mass average molecular mass of 1,000 or higher and exhibiting a bottom temperature in endothermic peaks observed by DSC measurement within a range from 100° C. to 120° C. are more preferable. Such a Fischer-Tropsch wax may be exemplified by Sasol Wax C1 (bottom temperature in endothermic peaks: 106.5° C.), Sasol Wax C105 (bottom temperature in endothermic peaks: 102.1° C.), and Sasol Wax SPRAY (bottom temperature in endothermic peaks: 102.1° C.) which are available from Sasol Wax GmbH.

The amount of the release agent used is preferably from 1% to 10% by mass based on the total mass of the toner core particles. When using a toner which includes toner particles in which the content of the release agent is excessively small, the desired effect for suppressing the occurrence of offset or image smearing in the resulting images may not be obtained. A toner which includes toner particles with an excessively large content of the release agent may degrade the heat-resistant storage stability of the toner since toner particles tend to agglomerate.

Charge Control Agent

Preferably, the toner core particles contain a charge control agent for the purpose of improving a charged level or a charge-increasing property, which is an indicator of chargeability to a predetermined charged level within a short time, of the toner particles, to thereby obtain a toner excellent in durability and stability. When the toner particles in the toner are positively charged to develop, a positively chargeable charge control agent is used; and when the toner particles in the toner are negatively charged to develop, a negatively chargeable charge control agent is used.

The charge control agent may be appropriately selected from conventional charge control agents used for toners heretofore. Specific examples of the positively chargeable charge control agent are azine compounds such as pyridazine, pyrimidine, pyrazine, ortho-oxazine, meta-oxazine, para-oxazine, ortho-thazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes consisting of azine compounds such as azine FastRed FC, azine FastRed 12BK, azine Violet BO, azine Brown 3G, azine Light Brown GR, azine Dark Green BH/C, azine Deep Black EW, and azine Deep Black 3RL; nigrosine compounds such as nigrosine, nigrosine salts, and nigrosine derivatives; acid dyes consisting of nigrosine compounds such as nigrosine BK, nigrosine NB, and nigrosine Z; metal salts of naphthenic acid or higher fatty acid; alkoxylated amines; alkylamides; quaternary ammonium salts such as benzylmethylhexyldecyl ammonium, and decyltrimethylammonium chloride. Among these positively chargeable charge control agents, nigrosine compounds are particularly preferable since a more rapid charge-increasing property may be obtained. These positively chargeable charge control agents may be used in a combination of two or more.

Resins having a quaternary ammonium salt, a carboxylic acid salt, or a carboxyl group as a functional group may also be used as the positively chargeable charge control agent. More specifically, styrene resins having a quaternary ammonium salt, acrylic resins having a quaternary ammonium salt, styrene-acrylic resins having a quaternary ammonium salt, polyester resins having a quaternary ammonium salt, styrene resins having a carboxylic acid salt, acrylic resins having a carboxylic acid salt, styrene-acrylic resins having a carboxylic acid salt, polyester resins having a carboxylic acid salt, styrene resins having a carboxylic group, acrylic resins having a carboxylic group, styrene-acrylic resins having a carboxylic group, and polyester resins having a carboxylic group may be exemplified. These resins may be an oligomer or a polymer.

Among the resins usable as the positively chargeable charge control agent, styrene-acrylic resins having a quaternary ammonium salt as a functional group are more preferable since the charged amount may be easily controlled within a desired range. In regards to the styrene-acrylic resins having a quaternary ammonium salt as a functional group, preferable specific examples of acrylic comonomers copolymerized with a styrene unit are (meth)acrylic acid alkyl esters such as methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate, and iso-butyl methacrylate.

The units derived from dialkylamino alkyl(meth)acrylates, dialkyl(meth)acrylamides, or dialkylamino alkyl(meth)acrylamides through a quaternizing step may be used as the quaternary ammonium salt. Specific examples of the dialkylamino alkyl(meth)acrylate are dimethylamino ethyl(meth)acrylate, diethylamino ethyl(meth)acrylate, dipropylamino ethyl(meth)acrylate, and dibutylamino ethyl(meth)acrylate; a specific example of the dialkyl(meth)acrylamide is dimethyl methacrylamide; and a specific example of the dialkylamino alkyl(meth)acrylamide is dimethylamino propylmethacrylamide. Additionally, hydroxyl group-containing polymerizable monomers such as hydroxy ethyl(meth)acrylate, hydroxy propyl(meth)acrylate, 2-hydroxy butyl(meth)acrylate, and N-methylol(meth)acrylamide may also be used in combination at the time of polymerization.

Specific examples of the negatively chargeable charge control agent are organic metal complexes, chelate compounds, monoazo metal complexes, acetylacetone metal complexes, aromatic hydroxycarboxylic acids, metal complexes of aromatic dicarboxylic acids, aromatic monocarboxylic acids, aromatic polycarboxylic acids, and metal salts, anhydrides, or esters thereof, and phenol derivatives such as bisphenol. Among these, organic metal complexes and chelate compounds are preferable. Among organic metal complexes and chelate compounds, acetylacetone metal complexes such as aluminum acetylacetonate and iron(II) acetylacetonate and salicylic acid metal complexes or salicylic acid metal salts such as 3,5-di-tert-butylsalicylic acid chromium are more preferable, and salicylic acid metal complexes or salicylic acid metal salts are particularly preferable. These negatively chargeable charge control agents may be used in a combination of two or more.

The amount of the positively or negatively chargeable charge control agent used is preferably from 0.1% to 10% by mass based on the total mass of the toner core particles. In cases of using a toner, which includes toner particles where the content of the charge control agent is excessively small, image density of the resulting images may be lower than a desired value or it may be difficult to maintain image density of the resulting images for a long period since it is difficult to stably charge the toner particles in a predetermined polarity. Moreover, in cases where the content of the charge control agent is excessively small in the toner particles, since it is difficult to uniformly disperse the charge control agent in the binder resin, fogging tends to occur in the resulting images or smear caused by toner components tends to occur in latent image bearing members. In cases of using a toner, which includes toner particles where the content of the charge control agent is excessively large, smear caused by toner components tends to occur in latent image bearing members or image defects due to an inferior charge under high temperature and high humidity caused by degradation of environmental resistance tend to occur in the resulting images.

Colorant

The toner core particles may contain a colorant as required. Conventional pigments or dyes may be used as the colorant depending on the color of the toner. Specific examples of the colorant are black pigments such as carbon black, acetylene black, lamp black, and aniline black; yellow pigments such as chrome yellow, zinc yellow, cadmium yellow, yellow iron oxide, mineral fast yellow, nickel titanium yellow, nables yellow, naphthol yellow S, hanza yellow G, hansa yellow 10G, benzidine yellow G, benzidine yellow GR, quinoline yellow lake, permanent yellow NCG, turtrazine lake, monoazo yellow, and diazo yellow; orange pigments such as red chrome yellow, molybdenum orange, permanent orange GTR, pyrazolone orange, balkan orange, and indanthrene brilliant orange GK; red pigments such as iron oxide red, cadmium red, minium, cadmium mercury sulfate, permanent red 4R, lisol red, pyrazolone red, watching red calcium salt, lake red D, brilliant carmine 6B, eosine lake, rhodamine lake B, alizarin lake, brilliant carmine 3B, and monoazo red; violet pigments such as manganese violet, fast violet B, and methyl violet lake; blue pigments such as pigment blue 27, cobalt blue, alkali blue lake, Victoria blue partially chlorinated product, fast sky blue, indanthrene blue BC, and phthalocyanine blue; green pigments such as chrome green, chromium oxide, pigment green B, malachite green lake, and final yellow green G; white pigments such as zinc white, titanium dioxide, antimony white, and zinc sulfate; and extender pigments such as barite powder, barium carbonate, clay, silica, white carbon, talc, and alumina white. These colorants may be used in a combination of two or more for the purpose of tailoring the toner to a desired hue.

The amount of the colorant used is preferably from 1% to 10% by mass and more preferably from 2% to 7% by mass based on the total mass of the toner core particles.

The colorant may also be used as a master batch where the colorant has been previously dispersed in a resin material such as a thermoplastic resin. When using the colorant as a master batch, the resin in the master batch is preferably of the same type as that of the binder resin.

Magnetic Powder

The toner core particles may contain a magnetic powder as required. The toner, which includes toner particles is composed of toner core particles containing the magnetic powder in the binder resin and a shell layer coating the toner core particles, may be used as a magnetic one-component developer. The magnetic powder may be exemplified by iron oxides such as ferrite and magnetite, ferromagnetic metals such as those of cobalt and nickel, alloys of iron and/or ferromagnetic metals, compounds of iron and/or ferromagnetic metals, ferromagnetic alloys via ferromagnetizing treatment like heat-treatment, and chromium dioxide.

The particle diameter of the magnetic powder is preferably from 0.1 μm to 1.0 μm and more preferably from 0.1 μm to 0.5 μm. When preparing the toner core particles using the magnetic powder with a particle diameter within this range, the magnetic powder may be easily dispersed into the binder resin.

In order to improve dispersibility into the binder resin, the magnetic powder surface-treated with a surface treatment agent such as a titanium coupling agent and/or a silane coupling agent may also be used.

The amount of the magnetic powder used is preferably from 35% to 65% by mass and more preferably from 35% to 55% by mass based on the total mass of the toner core particles. In cases of using a toner, which includes toner particles composed of toner core particles where the content of the magnetic powder is excessively large and a shell layer coating the toner core particles, it may be difficult to form images with an intended image density when forming images continuously for a long period or fixability may be extremely deteriorated. In cases of using a toner, which includes toner particles composed of toner core particles where the content of the magnetic powder is excessively small and a shell layer coating the toner core particles, fogging tends to occur in the resulting images or image density of resulting images may be decreased when printing images for a long period.

Resin Fine Particles

The resin fine particles for forming the shell layer are not particularly limited as long as they can coat the toner core particles. The resin fine particles for forming the shell layer are preferably a polymer of a monomer having an unsaturated bond since a shell layer with a predetermined structure may be easily formed. Preferably, the resin fine particles contain a resin that can be synthesized by a soap-free emulsion polymerization. The reason is that producing the resin fine particles by the soap-free emulsion polymerization allows the preparation of resin fine particles where their particle diameters are uniform and no or almost no surfactant is included.

The monomer having an unsaturated bond is not particularly limited as long as it is a monomer from which a resin having sufficient physical properties as the shell layer can be synthesized. The monomer having an unsaturated bond is preferably a vinyl monomer. The vinyl group in the vinyl monomer may be substituted at α-site thereof with an alkyl group. The vinyl group in the vinyl monomer may also be substituted with a halogen atom. The alkyl group, which the vinyl group may have, is preferably an alkyl group of from 1 to 6 carbon atoms, more preferably methyl or ethyl group, and particularly preferably methyl group. The halogen atom, which the vinyl group may have, is preferably chlorine or bromine atom and more preferably chlorine atom.

The vinyl monomer may also have a nitrogen-containing polar functional group or a fluorine-substituted hydrocarbon group. In a case of using a vinyl monomer having a nitrogen-containing polar functional group when producing a resin, positively chargeable property can be imparted to the resulting resin. In a case of using a vinyl monomer having a fluorine-substituted hydrocarbon group when producing a resin, negatively chargeable property can be imparted to the resulting resin. In a case of using the positively chargeable resin or the negatively chargeable resin as the material of the shell layer, a toner chargeable to an intended charged amount may be obtained even when no charge control agent is compounded in the toner core particles or the amount of the charge control agent compounded in the toner core particles is reduced.

Among vinyl monomers, specific examples of the monomer having no nitrogen-containing polar functional group or fluorine-substituted hydrocarbon group are styrenes such as styrene, o-methylstyrene, m-methylstyrene, p-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-ethoxystyrene, p-phenylstyrene, p-chlorostyrene, and 3,4-dichlorostyrene; ethylenically unsaturated monoolefins such as ethylene, propylene, butylene, and isobutylene; halogenated vinyls such as vinyl chloride, vinylidene chloride, vinyl bromide, and vinyl fluoride; vinyl esters such as vinyl acetate, vinyl propionate, vinyl benzoate, and vinyl butyrate; (meth)acrylic acid esters such as methyl (meth)acrylate, ethyl(meth)acrylate, n-butyl(meth)acrylate, isobutyl(meth)acrylate, propyl(meth)acrylate, n-octyl(meth) acrylate, dodecyl(meth)acrylate, 2-ethylhexyl(meth)acrylate, stearyl(meth)acrylate, 2-chloroethyl(meth)acrylate, phenyl(meth)acrylate, and methyl α-chloroacrylate; (meth) acrylic acid derivatives such as acrylonitrile; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; and vinyl naphthalines. Among these, styrenes are preferable and styrene is more preferable. These monomers may be used in a combination of two or more.

Examples of the vinyl monomer having a nitrogen-containing polar functional group are N-vinyl compounds, amino (meth)acrylic monomers, methacrylonitrile, and (meth) acrylic amide. Specific examples of the N-vinyl compound are N-vinyl pyrrole, N-vinyl carbazole, N-vinyl indole, and N-vinyl pyrrolidone. Preferable examples of the amino(meth) acrylic monomer are the compounds represented by the formula below:

$$CH2=C(R^1)—(CO)—X—N(R^2)(R^3)$$

(in the formula, $R^1$ represents hydrogen or a methyl group; $R^2$ and $R^3$ respectively represent a hydrogen atom or an alkyl group of from 1 to 20 carbon atoms; X represents —O—, —O-Q-, or —NH; and Q represents an alkylene group of from 1 to 10 carbon atoms, a phenylene group, or a combination of these groups).

In the above-mentioned formula, specific examples of $R^2$ and $R^3$ are methyl group, ethyl group, n-propyl group, isopropyl group, n-butyl group, iso-butyl group, sec-butyl group, tert-butyl group, n-pentyl group, iso-pentyl group, tert-pentyl group, n-hexyl group, n-heptyl group, n-octyl group, 2-ethylhexyl group, n-nonyl group, n-decyl group, n-undecyl group, n-dodecyl group (lauryl group), n-tridecyl group, n-tetradecyl group, n-pentadecyl group, n-hexadecyl group, n-heptadecyl group, n-octadecyl group (stearyl group), n-nonadecyl group, and n-icosyl group.

In the above-mentioned formula, specific examples of Q are methylene group, 1,2-ethanediyl group, 1,1-ethylene group, propane-1,3-diyl group, propane-2,2-diyl group, propane-1,1-diyl group, propane-1,2-diyl group, butane-1,4-diyl group, pentane-1,5-diyl group, hexane-1,6-diyl group, heptane-1,7-diyl group, octane-1,8-diyl group, nonane-1,9-diyl group, decane-1,10-diyl group, p-phenylene group, m-phenylene group, o-phenylene group, and a divalent group without hydrogen at 4-site of phenyl group in a benzyl group.

Specific examples of the amino(meth)acrylic monomer represented by the above-mentioned formula are N,N-dimethylamino(meth)acrylate, N,N-dimethylaminomethyl (meth)acrylate, N,N-diethylaminomethyl(meth)acrylate, 2-(N,N-methylamino)ethyl(meth)acrylate, 2-(N,N-diethylamino)ethyl(meth)acrylate, 3-(N,N-dimethylamino)propyl (meth)acrylate, 4-(N,N-dimethylamino)butyl(meth)acrylate, p-N,N-dimethylaminophenyl(meth)acrylate, p-N,N-diethylaminophenyl(meth)acrylate, p-N,N-dipropylaminophenyl (meth)acrylate, p-N,N-di-n-butylaminophenyl(meth)acrylate, p-N-laurylaminophenyl(meth)acrylate, p-N-stearylaminophenyl(meth)acrylate, (p-N,N-dimethylaminophenyl)methyl(meth)acrylate, (p-N,N-diethylaminophenyl)methyl(meth)acrylate, (p-N,N-di-n-propylaminophenyl)methyl(meth)acrylate, (p-N,N-di-n-butylaminophenyl)methylbenzyl(meth)acrylate, (p-N-laurylaminophenyl)methyl(meth)acrylate, (p-N-stearylaminophenyl)methyl(meth)acrylate, N,N-dimethylaminoethyl(meth)acrylamide, N,N-diethylaminoethyl(meth)acrylamide, 3-(N,N-dimethylamino)propyl(meth)acrylamide, 3-(N,N-diethylamino)propyl(meth)acrylamide, p-N,N-dimethylaminophenyl(meth)acrylamide, p-N,N-diethylaminophenyl(meth)acrylamide, p-N,N-di-n-propylaminophenyl(meth)acrylamide, p-N,N-di-n-butylaminophenyl(meth)acrylamide, p-N-laurylaminophenyl(meth)acrylamide, p-N-stearylaminophenyl(meth)acrylamide, (p-N,N-dimethylaminophenyl)methyl(meth)acrylamide, (p-N,N-diethylaminophenyl)methyl(meth)acrylamide, (p-N,N-di-n-propylaminophenyl)methyl(meth)acrylamide, (p-N,N-di-n-butylaminophenyl)methyl(meth)acrylamide, (p-N-laurylaminophenyl)methyl(meth)acrylamide, and (p-N-stearylaminophenyl)methyl(meth)acrylamide.

The vinyl monomer having a fluorine-substituted hydrocarbon group is not particularly limited as long as it is used for producing a fluorine-containing resin. Specific examples of the vinyl monomer having a fluorine-substituted hydrocarbon group are fluoroalkyl(meth)acrylates such as 2,2,2-trifluoroethyl acrylate, 2,2,3,3-tetrafluoropropyl acrylate, 2,2,3,3,4,4,5,5-octafluoroamyl acrylate, and 1H,1H,2H,2H-heptadecafluorodecyl acrylate; and fluoroolefins such as trifluorochloroethylene, vinylidene fluoride, trifluoroethylene, tetrafluoroethylene, trifluoropropylene, and hexafluoropropene. Among these, fluoroalkyl(meth)acrylates are preferable.

The addition polymerization process of the monomer having an unsaturated bond may be optionally selected from the processes of solution polymerization, bulk polymerization, emulsion polymerization, and suspension polymerization. Among these production processes, an emulsion polymerization process is preferable since resin fine particles with a uniform particle diameter may be easily obtained.

In the polymerization of the vinyl monomers described above, conventional polymerization initiators such as potassium persulfate, acetyl peroxide, decanoyl peroxide, lauroyl peroxide, benzoyl peroxide, azobisisobutyronitrile, 2,2'-azobis-2,4-dimethyl valeronitrile, and 2,2'-azobis-4-methoxy-2,4-dimethyl valeronitrile may be used. The amount of these polymerization initiators used is preferably from 0.1% to 15% by mass based on the total mass of monomers.

The process for producing the resin fine particles by the emulsion polymerization process is preferably a soap-free emulsion polymerization process using no emulsifying agent (surfactant). In the soap-free emulsion polymerization process, a radical of the initiator occurring in an aqueous phase induces the polymerization of a monomer slightly dissolved in the aqueous phase. As the polymerization progresses, particle cores of insolubilized resin fine particles are formed. The use of the soap-free emulsion polymerization process may result in resin fine particles with a narrow distribution of particle diameters and thus the average particle diameter of the resin fine particles may be easily controlled within a range from 0.03 μm to 1 μm. Therefore, the use of the soap-free emulsion polymerization process may result in the resin fine particles with a uniform particle diameter.

By use of the resin fine particles with a uniform particle diameter obtained through the soap-free emulsion polymerization process, variation of adhesion forces of the resin fine particles to the toner core particles can be reduced and thus a homogeneous shell layer with a uniform thickness can be formed. The resin fine particles produced by the soap-free emulsion polymerization process are formed using no emulsifying agent (surfactant). Therefore, a shell layer resistant to being affected by moisture can be formed by using the resin fine particles obtained through the soap-free emulsion polymerization process.

The resin fine particles may contain components such as a colorant and a charge control agent as described above as required. In cases where the resin fine particles contain a sufficient amount of a charge control agent, the toner core particles may include no charge control agent.

The glass transition point of the resin constituting the resin fine particles is preferably from 45° C. to 90° C. and more preferably from 50° C. to 80° C.

When a shell layer is formed using the resin fine particles consisting of a resin with excessively low glass transition points, cracks in a direction approximately perpendicular to the surface of the toner core particles are unlikely to be formed inside the shell layer because of excessive deformation of the resin fine particles. In this case, since break of the shell layer is unlikely to occur even if a pressure is applied to the toner particles when fixing, it is difficult to fix the toner on recording media in a low-temperature region. Besides, the toner with a shell layer formed using the resin fine particles consisting of a resin with excessively low glass transition points tends to agglomerate during storage of the toner at high temperatures.

In cases where the shell layer is formed using the resin fine particles consisting of a resin with excessively high glass transition points, the resin fine particles do not deform to an intended level and thus it is difficult to form a shell layer with a predetermined shape. In this case, since there remains a gap between the resin fine particles, components such as a release agent in the toner core particles are likely to exude onto a surface of the toner during storage of the toner at high temperatures.

The glass transition point of the resin constituting the resin fine particles can be determined from a changing point of specific heat of the resin constituting the resin fine particles using a differential scanning calorimeter (DSC). Hereinafter, the method of measuring the glass transition point using the differential scanning calorimeter (DSC) is explained.

Method of Measuring Glass Transition Point

The glass transition point of the resin constituting the resin fine particles can be determined by measuring an endothermic curve of the resin constituting the resin fine particles using a differential scanning calorimeter (DSC-200, by Seiko Instruments Inc.) as a measuring device in accordance with a process based on JIS K 7121-1987. 10 mg of the resin constituting the resin fine particles to be measured is loaded into an aluminum pan and an empty aluminum pan is used as a reference. An endothermic curve is obtained under a condition of measuring temperature range from 25° C. to 200° C., temperature-increase rate 10° C./min, and normal temperature and normal humidity, then the glass transition point of the resin constituting the resin fine particles can be determined from the resulting endothermic curve of the resin constituting the resin fine particles.

The softening point of the resin constituting the resin fine particles is preferably from 100° C. to 250° C. and more preferably from 110° C. to 240° C. The softening point of the resin constituting the resin fine particles is preferably higher than the softening point of the binder resin in the toner core particles and more preferably 10° C. to 140° C. higher than the softening point of the binder resin. When the shell layer is formed using the resin fine particles consisting of the resin with the softening point within this range, the parts of the resin fine particles contacting the toner core particles are unlikely to deform when the resin fine particles are embedded into the toner core particles. Consequently, convex parts derived from the shape of the resin fine particles prior to forming a shell layer are likely to be formed at an inner surface of the shell layer.

The softening point of the resin constituting the resin fine particles can be measured using a flow tester. Hereinafter, the method of measuring a softening point of the resin constituting the resin fine particles using a flow tester is explained.

Method of Measuring Softening Point

The softening point ($F_{1/2}$) of the resin constituting the resin fine particles is measured using an elevated flow tester (CFT-500D, by Shimadzu Co.). About 1.8 g of the resin constituting the resin fine particles is filled into a molding tool for preparing a measurement sample, then to which a pressure of 4 MPa is applied to thereby form a columnar pellet of the resin of diameter 1 cm and height 2 cm. The resulting pellet is set on the flow tester and the softening point (Tm) of the resin constituting the resin fine particles is measured under a condition of plunger load 30 kg, die hole diameter 1 mm, die length 1 mm, temperature-increase rate 4° C./min, and measuring temperature range from 70° C. to 160° C. The softening point ($F_{1/2}$) of the resin constituting the resin fine particles is read from an S-shaped curve that is obtained from the measurement of the flow tester and that shows a relation between temperature (° C.) and stroke (mm).

Figure 2:
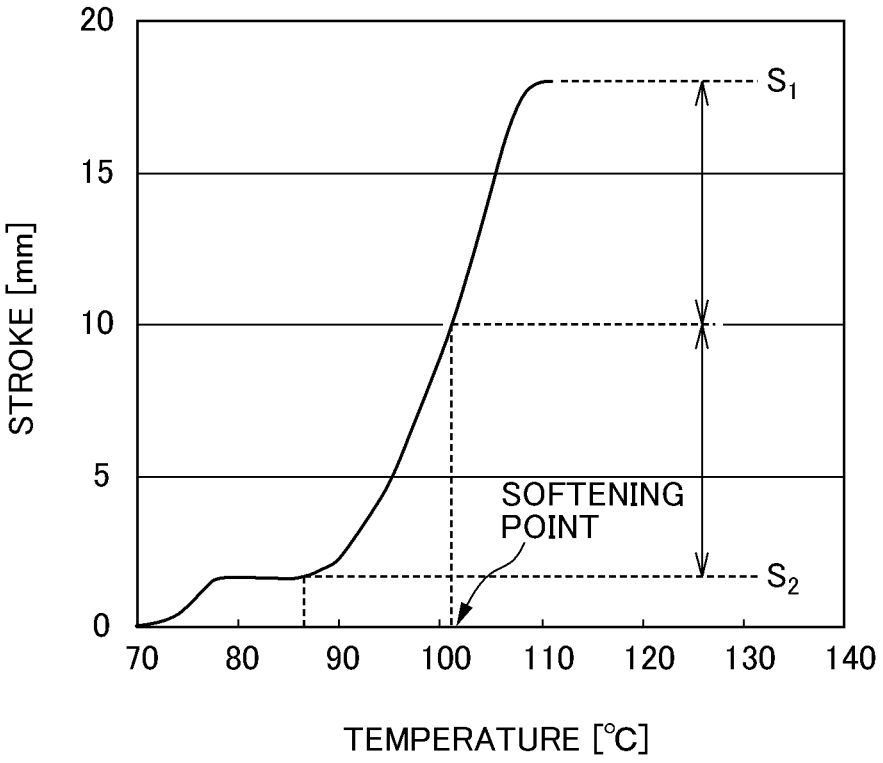
FIG. 2 is a view that illustrates a method of measuring a softening point using an elevated flow tester.

The way to read the softening point ($F_{1/2}$) of the resin constituting the resin fine particles is explained with reference to FIG. 2. A maximum stroke value is defined as $S_1$, and a base line stroke value on the lower temperature side is defined as $S_2$. The temperature at which the stroke value is $(S_1+S_2)/2$ in the S-shaped curve is defined as the softening point ($F_{1/2}$) of the resin constituting the resin fine particles.

The average particle diameter of the resin fine particles is preferably from 30 nm to 1000 nm, more preferably from 40 nm to 700 nm, particularly preferably from 45 nm to 500 nm, and most preferably from 45 nm to 300 nm. When producing a toner using the resin fine particles with such a particle diameter, the surface of the toner core particles may be easily coated uniformly with the resin fine particles aligned into a monolayer and thus a shell layer with an intended structure may be easily formed.

In cases of producing a toner using the resin fine particles with an excessively small average particle diameter, a shell layer with a preferable thickness may not be formed on the surface of the toner core particles and thus a toner with excellent heat-resistant storage stability may not be obtained. In cases of producing a toner using the resin fine particles with an excessively large average particle diameter, it is difficult to attach the resin fine particles uniformly onto the surface of the toner core particles. Therefore, it is difficult to form the shell layer with a predetermined structure and thus a toner with excellent heat-resistant storage stability is unlikely to be obtained.

The average particle diameter of the resin fine particles can be adjusted by controlling polymerization conditions and using conventional processes such as pulverizing processes and classifying processes. The average particle diameter of the resin fine particles can be computed as a number average particle diameter by measuring a particle diameter for at least 50 resin fine particles from an electron microscope photograph taken using a field emission scanning electron microscope (e.g., JSM-6700F, by JEOL Ltd.).

The mass average molecular mass (Mw) of the resin constituting the resin fine particles is preferably from 5,000 to 100,000. The mass average molecular mass (Mw) of the resin constituting the resin fine particles can be determined using gel permeation chromatography (GPC) from a molecular mass distribution on a mass basis. Preferably, the molecular mass ($M_p$) at a maximum peak in the molecular mass distribution on a mass basis, measured using gel permeation chromatography, of the resin constituting the resin fine particles is from 5,000 to 100,000.

When a shell layer is formed using resin fine particles consisting of a resin with excessively small Mw and $M_p$, cracks in a direction approximately perpendicular to the toner core particle may not be formed inside the shell layer because of excessive deformation of the resin fine particles. In this case, since break of the shell layer is unlikely to occur even if a pressure is applied to the toner particle during fixing, the toner may not be fixed on recording media. Toner particles, produced using resin fine particles consisting of a resin with excessively small Mw and $M_p$, tends to agglomerate during storage of the toner at high temperatures.

In cases where a shell layer is formed using resin fine particles consisting of a resin with excessively high Mw and $M_p$, the resin fine particles may not deform to an intended level and thus a shell layer with a predetermined shape may not be formed. In this case, since there remain gaps between the resin fine particles, components such as a release agent in the toner core particle are likely to exude onto a surface of the toner particle during storage of the toner at high temperatures. When using a toner including toner particles produced using resin fine particles consisting of a resin with excessively high Mw and $M_p$, the shell layer formed of the resin fine particles may be resistant to break during fixing the toner. Therefore, the shell layer may disturb to fix the toner and thus the toner may not be appropriately fixed on recording media.

Hereinafter, the method of measuring a molecular mass distribution on a mass basis using gel permeation chromatography (GPC) is explained.

Method of Measuring Molecular Mass Distribution 10 mg of resin fine particles are dissolved in 5 mL of tetrahydrofuran (THF) at room temperature. The resulting solution is filtered using a non-aqueous chromatodisk of opening 0.45 μm, thereby obtaining a sample solution. Using the resulting sample solution, measurement is performed under the condition below.

Measurement Condition

Apparatus: HLC-8220GPC (by Tosoh Co.)

Column: two of TSK-GEL Super HZM-H (by Tosoh Co.) and one of TSK guard column Super HZ-H (by Tosoh Co.)

Eluent: tetrahydrofuran (THF)

Flow rate: 0.200 mL/min

Amount of sample injected: 10 μL

Measuring temperature: 40° C.

Detector: IR detector

Calibration curve: prepared on the basis of F-380, F-128, F-40, F-10, F-4, F-1, and A-2500 selected from standard samples (TSK Standard Polystyrene, by Tosoh Co.).

It is preferred for the resin constituting the resin fine particles that the temperature ($T_1$) at a melt viscosity of $1.0\times10^5$ Pa·s is from 110° C. to 160° C. and the temperature ($T_2$) at a melt viscosity of $1.0\times10^4$ Pa·s is from 130° C. to 170° C.

When a shell layer is formed using resin fine particles consisting of a resin with excessively low $T_1$ and $T_2$, cracks in a direction approximately perpendicular to the toner core particle may not be formed inside the shell layer because of excessive deformation of the resin fine particles upon application of an external force. In this case, since break of the shell layer is unlikely to occur even if a pressure is applied to the toner particle during fixing, the toner may not be appropriately fixed on recording media. Toner particles, produced using resin fine particles consisting of a resin with excessively low $T_1$ and $T_2$, tends to agglomerate during storage of the toner at high temperatures.

In cases where a shell layer is formed using resin fine particles consisting of a resin with excessively high $T_1$ and $T_2$, the resin fine particles may not deform to an intended level upon application of an external force and thus a shell layer with a predetermined shape may not be formed. In this case, since there remains a gap between the resin fine particles, components such as a release agent in the toner core particle are likely to exude onto a surface of the toner particle during storage of the toner at high temperatures. When using a toner containing toner particles produced using resin fine particles consisting of a resin with excessively high $T_1$ and $T_2$, the shell layers formed of the resin fine particles may be resistant to break during fixing the toner. Therefore, the shell layer may disturb to fix the toner and thus the toner may not be appropriately fixed on recording media.

$T_1$ and $T_2$ can be measured using a flow tester. The method of measuring $T_1$ and $T_2$ using the flow tester shown later may be a method similar to the method of measuring a softening point of a resin constituting resin fine particles that uses the flow tester described above while properly changing the measuring conditions.

The amount of the resin fine particles used is preferably from 1 to 20 parts by mass and more preferably from 3 to 15 parts by mass based on 100 parts by mass of the toner core particles. In cases where the amount of the resin fine particles used is excessively small when producing the toner, the entire surfaces of the toner core particles may not be coated with the resin fine particles. If the entire surfaces of the toner core particles cannot be coated by the resin fine particles, the toner particles in the toner may agglomerate during storage at high temperatures and thus heat-resistant storage stability of the toner may degrade. In cases where the amount of the resin fine particles used is excessively large when producing the toner particles in the toner, the shell layers may become thick. In this case, the toner with excellent fixability may not be obtained.

External Additive

The toner core particles coated with the shell layer may be treated using an external additive as required. Hereinafter, the particles treated using the external additive is also described as "toner base particles".

The external additive may be exemplified by silica and metal oxides such as alumina, titanium oxide, magnesium oxide, zinc oxide, strontium titanate, and barium titanate. These external additives may be used in a combination of two or more.

The particle diameter of the external additive is preferably from 0.01 μm to 1.0 μm.

The amount of the external additive used is preferably from 0.1% to 10% by mass and more preferably from 0.2% to 5% by mass based on the total mass of the toner base particles produced by forming the shell layer on the surface of the toner core particles. Toner particles treated with an excessively small amount of the external additive exhibits low hydrophobicity. Such a toner which includes toner particles with low hydrophobicity is likely to be affected by water molecules in air under high temperature and high humidity environments. In cases of using a toner, which includes toner particles treated with an excessively small amount of the external additive, problems such as decrease of image density of resulting images due to extreme lowering of the charged amount of the toner and lowering of flowability of the toner tend to occur. In cases of using a toner, which includes toner particles treated with an excessively large amount of the external additive, decrease of image density of resulting images may be caused due to an excessive charge up of the toner particles.

Carrier

The toner may be mixed with a desired carrier and used as a two-component developer. In cases of preparing the two-component developer, a magnetic carrier is preferably used as the carrier.

A carrier, whose carrier core material is coated with a resin, may be exemplified as a preferable carrier in cases of using the toner for electrostatic latent image development as the two-component developer. Specific examples of the carrier core material may be exemplified by metal particles such as iron, oxidized iron, reduced iron, magnetite, copper, silicon steel, ferrite, nickel, and cobalt; alloy particles of these materials and metals such as manganese, zinc, and aluminum; alloy particles such as iron-nickel alloy and iron-cobalt alloy; ceramic particles such as titanium oxide, aluminum oxide, copper oxide, magnesium oxide, lead oxide, zirconium oxide, silicon carbide, magnesium titanate, barium titanate, lithium titanate, lead titanate, lead zirconate, and lithium niobate; particles of higher permittivity materials such as ammonium dihydrogen phosphate, potassium dihydrogen phosphate, and Rochelle salts; resin carriers dispersing these magnetic particles into resins.

Specific examples of the resin, which coats the carrier core material, may be exemplified by (meth)acrylic polymers, styrene polymers, styrene-(meth)acrylic copolymers, olefin polymers (polyethylene, chlorinated polyethylene, and polypropylene), polyvinyl chloride, polyvinyl acetate, polycarbonate, cellulose resins, polyester resins, unsaturated polyester resins, polyamide resins, polyurethane resins, epoxy resins, silicone resins, fluorine resins (polytetrafluoroethylene, polychlorotrifluoroethylene, and polyvinylidene fluoride), phenol resins, xylene resins, diallyl phthalate resins, polyacetal resins, and amino resins. These resins may be used in a combination of two or more.

The particle diameter of the carrier, measured using an electron microscope, is preferably from 20 μm to 200 μm and more preferably from 30 μm to 150 μm.

The apparent density of the carrier, which depends on a carrier composition and a surface structure, is preferably from 2,400 kg/m$^3$ to 3,000 kg/m$^3$.

In cases where the toner is used as a two-component developer, the content of the toner is preferably from 1% to 20% by mass and more preferably from 3% to 15% by mass based on the mass of the two-component developer. By adjusting the content of the toner in the two-component developer within this range, images with an appropriate image density may be successively formed, and pollution inside image forming apparatuses and adhesion of the toner to transfer paper may be suppressed because of suppressing scattering of the toner from developing units.

Method of Producing Toner Particles

The method of producing the toner particles in the toner of the present disclosure is not particularly limited as long as toner particles where toner core particles are coated with a shell layer of a predetermined structure can be produced. If desired, external treatment to attach an external additive to a surface of toner base particles may be applied using the toner core particles coated with a shell layer as toner base particles. A preferable method of producing the toner particles in the toner of the present disclosure is explained with respect to a method of producing toner core particles, a method of forming a shell layer, and an external addition treatment method in order below.

Method of Producing Toner Core Particles

The method of producing toner core particles is not particularly limited as long as optional components such as a colorant, a release agent, a charge control agent, and a magnetic powder can be appropriately dispersed in a binder resin. A specific example of a desirable method of producing the toner core particles may be such that a binder resin and components including a colorant, a release agent, a charge control agent, and a magnetic powder are mixed using a mixer, then the binder resin and the components to be compounded with the binder resin are melted and kneaded using a kneading machine such as a single or twin screw extruder, and the kneaded material after cooling is pulverized and classified. Typically, the average particle diameter of the toner core particles is preferably from 5 μm to 10 μm.

In the toner of the present disclosure, when adjusting the average circularity of toner particles with a primary particle diameter from 3 μm to 10 μm into from 0.960 to 0.970, the adjusting method may be exemplified by (i) and (ii) below:

(i) a method of coarsely pulverizing and finely pulverizing a melt-kneaded material of components in toner core particle followed by heat-treating the resulting pulverized material with a predetermined particle diameter, and (ii) a method of finely pulverizing the melt-kneaded material by divided multiple stages when pulverizing the melt-kneaded material by coarse pulverizing and fine pulverizing.

The above-mentioned method of fine pulverizing by divided multiple stages in the method (ii) are repeated until the particle diameter of finely pulverized material comes to an intended particle diameter. Method of fine pulverizing by divided multiple stages is a method in which an operation of once collecting a finely pulverized material from a pulverizing device before pulverizing a coarsely pulverized material using the pulverizing device results in pulverized particles with an intended particle diameter and an operation of finely pulverizing again the collected finely pulverized material using the pulverizing device. In a case of producing the toner core particles by a production method including the method (ii), the number of stages in the fine pulverizing step, which is not particularly limited, is preferably at least 3 times.

The mechanical pulverizing device used in the finely pulverizing step may be exemplified by Turbo mill (by Freund-Turbo Co.) and Criptron (by Earthtechnica Co.). When performing the finely pulverizing step by the divided multiple stages, different mechanical pulverizing devices may be used in the respective stages.

Method of Forming Shell Layer

The shell layer is formed using spherical resin fine particles. More specifically, the shell layer is formed by a method including:

I) a step of making spherical resin fine particles adhere to the surface of the toner core particles so as to not overlap thereon in a direction perpendicular to the surfaces of the toner core particles and forming layers of the resin fine particles that covers the entire surfaces of the toner core particles, and II) a step of smoothening the outer surfaces of the layers of the resin fine particles to thereby form shell layers by applying an external force to the outer surfaces of the layers of the resin fine particles and deforming the resin fine particles in the layers of the resin fine particles.

The method of forming the shell layer using the resin fine particles is preferably a method of using a mixing device capable of mixing the toner core particles and the resin fine particles under a dry condition. A specific method thereof may be exemplified by the method that uses a mixing device capable of applying a mechanical external force to the toner core particles, onto the surfaces of which the resin fine particles have adhered, while making the resin fine particles adhere to the surfaces of the toner core particles and thereby form the shell layers on the surfaces of the toner core particles. The mechanical external force may be exemplified by a shear force that is applied to the toner core particles and that is derived from a shear between the toner core particles themselves or a shear occurring between the toner core particles and an inner wall of the mixing device, a rotor, or a stator; and an impulsive force that is applied to the toner core particles and that is derived from collision between the toner core particles themselves or collision between the toner core particles and an inner wall of the mixing device, when the toner core particles rapidly move within a narrow and small space in the mixing device.

A more specific method is explained. Initially, the toner core particles and the resin fine particles are mixed in a mixing device, thereby making the resin fine particles uniformly adhere to the surfaces of the toner core particles so as to not overlap in a direction perpendicular to the surfaces of the toner core particles. When contacting the toner core particle with a large particle diameter and the resin fine particle with a small particle diameter, the surface of the toner core particle microscopically assume a planar surface and the surface of the resin fine particles cause a surface-surface contact. Therefore, the resin fine particles tend to easily adhere to the toner core particle. On the other hand, when contacting the resin fine particles themselves, the contact occurs between curved surfaces of two resin fine particles to thereby cause a point-point contact. Therefore, in the step of making the resin fine particles adhere to the toner core particles, even when a resin fine particle is further adhering to the resin fine particle which has adhered to the surface of the toner core particle, the resin fine particle adhering to the resin fine particle is easily detached from the resin fine particle by a mechanical external force by the mixing device which is applied to the toner core particle to which the resin fine particle has adhered. For this reason, in accordance with the method explained below, the toner core particles are coated with the resin fine particles in a way that the resin fine particles do not overlap in a direction perpendicular to the surfaces of the toner core particles.

When making the resin fine particles adhere to the toner core particles, the above-mentioned mechanical external force is applied to the layers of the resin fine particles at the surfaces of the toner core particles. As a result, the resin fine particles deform while being embedded into the toner core particles by action of the mechanical external force, and thus the outer surfaces of the layers of the resin fine particles covering the entire surfaces of the toner core particles are smoothened and the layers of the resin fine particles transform into shell layers. When the shell layers are formed, whereby the smoothening progresses at the outer surfaces of the shell layers, boundary surfaces between the resin fine particles remain inside the shell layers. Therefore, cracks in a direction approximately perpendicular to the surfaces of the toner core particles are formed inside the shell layers formed using the resin fine particles.

In this stage, when the material of the toner core particles has a hardness equivalent or somewhat higher than that of the resin fine particles forming the shell layer, the inner surface of the shell layer (surface of the side of the toner core particles) may be smoothened. On the other hand, when the material of the toner core particles is softer than the material of the resin fine particles forming the shell layer, the parts of the resin fine particles contacting the toner core particles are resistant to deforming when the resin fine particles are embedded into the toner core particles, therefore, convex parts derived from the shape of the resin fine particles prior to transforming into the shell layer are likely to be formed at the inner surface of the shell layer. In this case, the convex part is formed between two cracks in the shell layer.

In the above-mentioned method, when the mechanical external force is weak, the resin fine particles do not deform to an intended level and thus the shell layer with a predetermined shape may not be formed. Although the condition to form the shell layer with a predetermined shape depends on the type of devices used for forming the shell layer, an appropriate condition for forming a predetermined shell layer can be determined with respect to various devices by confirming the structure of shell layers of toner particles obtained through various conditions while changing operation conditions in a stepwise manner such that the mechanical external force applying to toner core particles coated with resin fine particles becomes larger. However, when the mechanical external force is too large, problems may occur such that the resin fine particles excessively deform and thus cracks in a direction approximately perpendicular to the surface of the toner core particles are not formed inside the shell layer or the mechanical external force is converted into heat and thus the toner core particles or the resin fine particles melt.

The devices, allowing to coat the toner core particles using the resin fine particles and also to apply a mechanical external force to the toner core particles coated with the resin fine particles, may be exemplified by Hybridizer NHS-1 (by Nara Machinery Co.), Cosmos System (by Kawasaki Heavy Industries, Ltd.), Henschel mixer (by Nippon Coke & Engineering Co.), Multi-Purpose mixer (by Nippon Coke & Engineering Co.), COMPOSI (by Nippon Coke & Engineering Co.), Mechanofusion system (by Hosokawa Micron Co.), Mechanomill (by Okada Seiko Co.), and Nobilta (by Hosokawa Micron Co.).

External Addition Treatment Method

The method of treating the toner base particles using an external additive is not particularly limited and the toner base particles can be treated in accordance with methods known heretofore. Specifically, treatment conditions are controlled such that particles of the external additive are not embedded into toner base particles, and the treatment using the external additive is performed by a mixer such as HENSCHEL mixer and NAUTA mixer.

The toner for electrostatic latent image development of the present disclosure explained above is excellent in fixability and heat-resistant storage stability and thus is favorably used for various image forming apparatuses.

The toner for electrostatic latent image development of the present disclosure explained above is excellent in fixability and heat-resistant storage stability and thus is favorably used in various image forming apparatuses. Among the toners for electrostatic latent image development of the present disclosure, the toner in which the average circularity of toner particles with a particle diameter from 3 μm to 10 μm is from 0.960 to 0.970 allows suppression of the occurrence of image defects in resulting images due to passing through of the toner particles in cleaning units and image defects such as void and letter scattering in resulting images, therefore, it is favorably used in particular.

Image Forming Method

The image forming apparatus, employed for forming images using the toner for electrostatic latent image development of the present disclosure, may be appropriately selected from conventional image forming apparatuses. The image forming apparatus is preferably a tandem-type color image forming apparatus which uses toners of two or more colors as described later. Hereinafter, the image forming method using the tandem-type color image forming apparatus is explained.

The tandem-type color image forming apparatus explained below is equipped with two or more latent image bearing members which are arranged in parallel in order to form toner images using toners with different colors on the surfaces of the two or more latent image bearing members; and two or more development units with rollers (development sleeves), disposed oppositely to the respective latent image bearing members, which carry the toner on the surface and convey it, and supply the conveyed toner respectively to the surfaces of the latent image bearing members. The development units supply the toners to the latent image bearing members.

Figure 3:
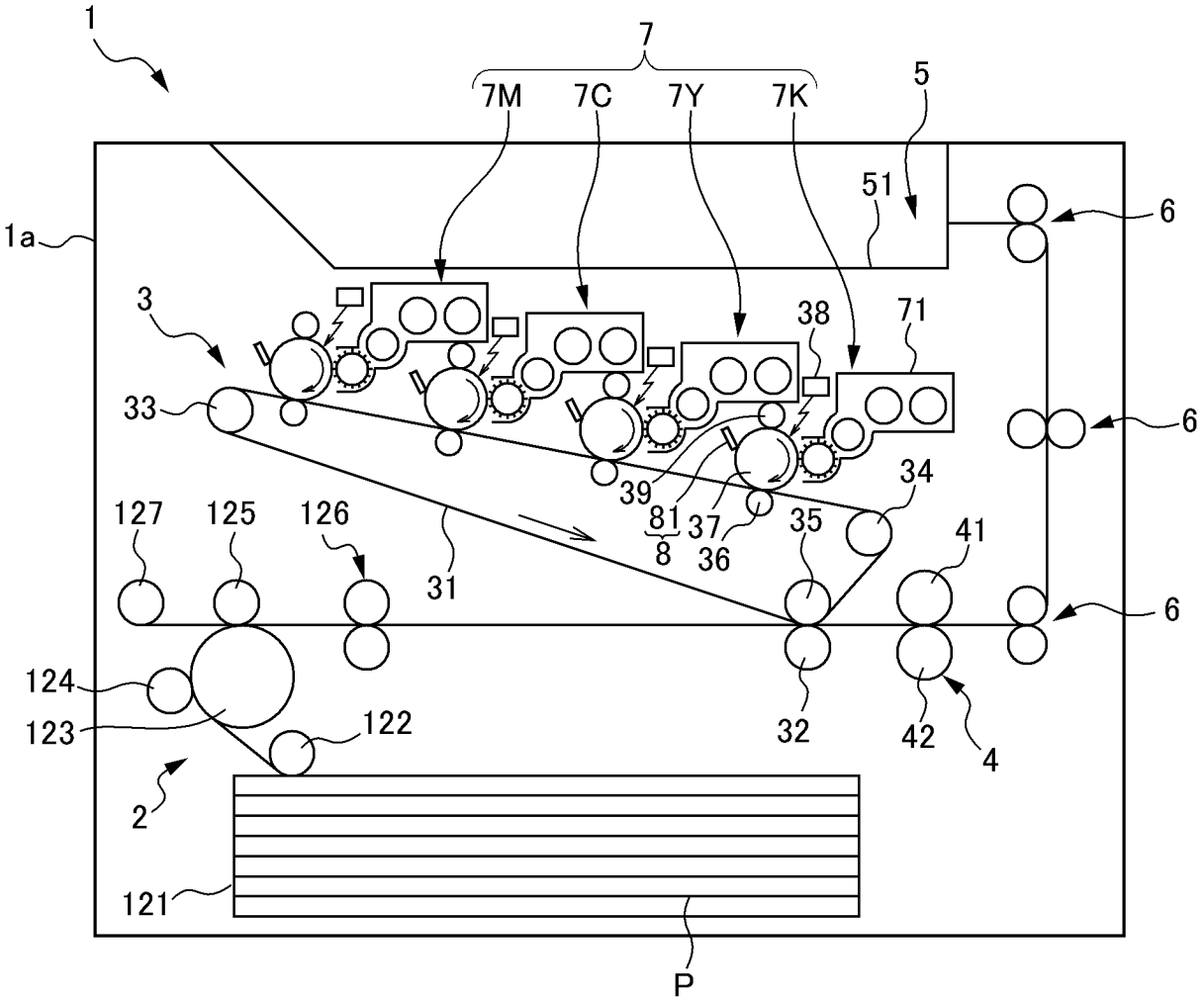
FIG. 3 is a view showing a configuration of an image forming apparatus.

FIG. 3 is a view illustrating a configuration of a preferable image forming apparatus. Here, the image forming apparatus is explained with reference to a color printer 1 as an example.

The color printer 1 has a box-shaped device body 1*a* as shown in FIG. 3. A paper feed unit 2 that feeds a paper P as a recoding medium, an image forming unit 3 that transfers a toner image based on image data on the paper P while conveying the paper P fed from the paper feed unit 2, and a fixing unit 4 that applies a fixing treatment to fix an unfixed toner image transferred on the paper P by the image forming unit 3 to the paper are provided in the device body 1*a*. A paper discharge unit 5, to which the paper P, applied with the fixture treatment by the fixing unit 4, is discharged, is further provided at an upper side of the device body 1*a*.

The paper feed unit 2 is equipped with a paper feed cassette 121, a pick-up roller 122, paper feed rollers 123, 124, 125, and a pair of registration rollers 126. The paper feed cassette 121 is provided detachably to the device body 1*a* and accommodates the paper P. The pick-up roller 122 is provided at a position of upper left of the paper feed cassette 121 as shown in FIG. 3 to pick up the paper P accommodated in the paper feed cassette 121 one by one. The paper feed rollers 123, 124, 125 send the paper P picked up by the pick-up roller 122 to a paper conveying path. The pair of registration rollers 126 direct the paper P sent to the paper conveying path by the paper feed rollers 123, 124, 125 to temporally wait and feed it to the image forming unit 3 at a predetermined timing.

The paper feed unit 2 is further equipped with a manual feed tray (not shown) attached at left side of the device body 1*a* shown in FIG. 3 and a pick-up roller 127. The pick-up roller 127 picks up the paper P disposed on the manual feed tray. The paper P picked up by the pick-up roller 127 is sent to a paper conveying path by the paper feed rollers 123, 125 and fed to the image forming unit 3 by the pair of registration rollers 126 at a predetermined timing.

The image forming unit 3 is equipped with an image forming part 7, an intermediate transfer belt 31 to which surface (contact side) a toner image based on image data telephotographed from computers is primarily transferred by the image forming part 7, and a secondary transfer roller 32 that secondarily transfers the toner image on the intermediate transfer belt 31 to the paper P sent from the paper feed cassette 121.

The image forming part 7 is equipped with a black unit 7K, a yellow unit 7Y, a cyan unit 7C, and a magenta unit 7M which are disposed from an upper stream side (right side in FIG. 3) to a downstream side in series along the moving direction of the intermediate transfer belt 31. In each of the units 7K,7Y, 7C, and 7M, a drum-shaped latent image bearing member 37 as an image bearing member is disposed rotatably along the arrow direction (clockwise direction) at a central position thereof. Furthermore, a charging unit 39, an exposure unit 38, a developing unit 71, a cleaning unit 8, and a neutralization unit (not shown) are disposed around each latent image bearing member 37 in series from an upper stream side of the rotating direction of the latent image bearing member 37.

The charging unit 39 uniformly charges the circumference of the latent image bearing member 37 which is being rotated in the arrow direction. The charging unit 39 is not particularly limited as long as it can uniformly charge the circumference of the latent image bearing member 37 and may be of non-contact or contact type. Specific examples of the charging unit include corona-charging devices, charging rollers, and charging brushes.

Considering the balance between the developing property and the charging capacity of the latent image bearing member 37, the surface potential (charged potential) of the latent image bearing member 37 is preferably from 200 V to 500 V and more preferably from 200 V to 300 V. When the surface potential applied to the surface of the latent image bearing member 37 is excessively low during forming images, the development field becomes insufficient and thus it is difficult to assure the image density of resulting images. When the surface potential of the latent image bearing member 37 is excessively high during forming images, problems such as insufficient charging capacity, insulation breakdown of the latent image bearing member 37, and an increase of the amount of emerging ozone may occur depending on a thickness of the photosensitive layer.

The latent image bearing member 37 may be exemplified by inorganic photoconductors such as of amorphous silicon and organic photoconductors where a mono-layer or laminated photoconductive layer containing components such as a charge generating agent, a charge transporting agent, and a binder resin is formed on a conductive substrate.

The exposure unit 38 is a so-called laser scanning unit where laser light is irradiated based on image data input from a personal computer (PC) as a higher-level device to the circumference of the latent image bearing member 37 uniformly charged using the charging unit 39. An electrostatic latent image is formed on the latent image bearing member 37, where the laser light has been irradiated, based on the image data input from the PC. In the development unit 71, the toner is supplied to the circumference of the latent image bearing member 37 where the electrostatic latent image has been formed. Upon supplying the toner to the circumference of the latent image bearing member 37, a toner image based on the image data is formed on the circumference of the latent image bearing member 37.

Among the toners of the present disclosure, when using the toner in which the average circularity of toner particles with a particle diameter from 3 μm to 10 μm is from 0.960 to 0.970, it is easy to suppress adherence of the toner to development rollers (sleeves) equipped by the development unit 71 when images are formed by supplying the toner to the circumference of the latent image bearing member 37. Therefore, by use of the above-mentioned toner of which the average circularity is within a predetermined range, good images may be easily formed in particular. The configuration of the development unit 71 is appropriately changed depending on a type of developers and a developing system. The toner image formed on a circumference of the latent image bearing member 37 by the developing unit 71 is primarily transferred on the intermediate transfer belt 31.

After completing the primary transfer of the toner image to the intermediate transfer belt 31, the toner remaining on the circumference of the latent image bearing member 37 is cleaned by the cleaning unit 8. The cleaning unit 8 is equipped with an elastic blade 81 and removes the toner remaining on the circumference of the latent image bearing member 37 by the elastic blade 81. The elastic blade is formed from urethane rubber or ethylene-propylene rubber. Among the toners of the present disclosure, when forming images using the toner in which the average circularity of toner particles with a particle diameter from 3 μm to 10 μm is from 0.960 to 0.970, the toner is unlikely to pass through the cleaning unit 8. Therefore, the occurrence of image defects in resulting images due to passing through of the toner in the cleaning unit 8 can be suppressed.

The neutralization unit eliminates the charge at the circumference of the latent image bearing member 37 after the primary transfer. The circumference of the latent image bearing member 37, which has been subjected to the cleaning treatment by the cleaning unit 8 and the neutralization unit, proceeds to the charging unit 39 for fresh charging treatment and is subjected to the fresh charging treatment.

The intermediate transfer belt 31 is an endless belt-shaped rotator and is tensioned over a plurality of rollers such as a driving roller 33, a driven roller 34, a backup roller 35, and primary transfer rollers 36 such that its surface side (contact surface) contacts the circumferences of the latent image bearing members 37. The intermediate transfer belt 31 can be rotated endlessly by two or more rollers under the condition of being pressed toward the latent image bearing member 37 by the primary transfer rollers 36 disposed oppositely to each of the latent image bearing members 37. The driving roller 33 is rotatably driven by a driving source such as a stepping motor (not shown) and provides the intermediate transfer belt 31 with a driving force for endless rotation. The driven roller 34, the backup roller 35, and the primary transfer rollers 36 are disposed rotatably and driven to rotate by following the endless rotation of the intermediate transfer belt 31. The rollers 34, 35, 36 are driven to rotate depending on the mover rotation of the driving roller 33 through the intermediate transfer belt 31 and also support the intermediate transfer belt 31.

The primary transfer roller 36 applies a primary transfer bias to the intermediate transfer belt 31. Consequently, the toner images formed on the latent image bearing members 37 are transferred in order (primary transfer) between each latent image bearing member 37 and each primary transfer roller 36 in a condition overprinting on the intermediate transfer belt 31 that is running around along the arrow direction (counterclockwise).

The secondary transfer roller 32 applies a secondary transfer bias to the paper P. Consequently, the toner image primarily transferred on the intermediate transfer belt 31 is secondarily transferred on the paper P between the secondary transfer roller 32 and the backup roller 35, and a color transfer image (unfixed toner image) is transferred on the paper P.

The fixing unit 4, which applies a fixing treatment to the transfer image transferred on the paper P by the image forming unit 3, is equipped with a heating roller 41 heated by an energizing heater (not shown) and a pressure roller 42 which is disposed oppositely to the heating roller 41 and of which the circumference is urged to contact the circumference of the heating roller 41.

Then, the transfer image, which has been transferred on the paper P by the secondary transfer roller 22 in the image forming unit 3, is fixed on the paper P by the fixture treatment of heating and pressing while the paper P is passing between the heating roller 41 and the pressure roller 42. Then, the fixture-treated paper P is discharged to the paper discharge unit 5. In the color printer 1 of this embodiment, two or more pairs of convey rollers 6 are placed at appropriate sites between the fixing unit 4 and the paper discharge unit 5.

The paper discharge unit 5 is formed by making a concave area at the top of the device body 1*a* of the color printer 1, and a discharged paper tray 51 to receive the discharged paper P is formed at the bottom of the concave area.

The color printer 1 forms an image on the paper P by action for forming the image as described above.

EXAMPLES

The present disclosure is explained more specifically with reference to examples below. In addition, the present disclosure is not limited to the examples.

Production Example 1

Production of Polyester Resin 1960 g of propylene oxide adduct of bisphenol A, 780 g of ethylene oxide adduct of bisphenol A, 257 g of dodecenyl succinic anhydride, 770 g of terephthalic acid, and 4 g of dibutyltin oxide were introduced into a reaction container. Next, the atmosphere in the reaction container was changed to nitrogen, and the temperature in the reaction container was raised to 235° C. while stirring. Then, after allowing to react at the same temperature for 8 hours, the pressure inside the reaction container was reduced to 8.3 kPa and the reaction was allowed to proceed for 1 hour. Thereafter, the reaction mixture was cooled to 180° C., and trimellitic anhydride was added to the reaction container so that an acid value of the reaction mixture became an intended value. Then, the temperature of the reaction mixture was raised to 210° C. at a rate of 10° C./hr and reaction was allowed to proceed at the same temperature. After completing the reaction, the content in the reaction container was taken out and cooled, thereby obtaining a polyester resin.

Production Example 2

Production of Toner Core Particles 89 parts by mass of a binder resin (the polyester resin obtained through Production Example 1), 5 parts by mass of a release agent (polypropylene wax 660P, by Sanyo Chemical Industries, Ltd.), 1 part by mass of a charge control agent (P-51, by Orient Chemical Industries Co.), and 5 parts by mass of a colorant (carbon black MA100, by Mitsubishi Chemical Co.) were mixed using a mixer, thereby obtaining a mixture. Next, the mixture was melted and kneaded using a twin screw extruder, thereby obtaining a kneaded material. The kneaded material was coarsely pulverized using a pulverizing device (Rotoplex, by Toakikai Co.), thereby obtaining a coarsely pulverized material. The coarsely pulverized material was finely pulverized using a mechanical pulverizing device (Turbo mill, by Turbo Industries, Co.), thereby obtaining a finely pulverized material. The finely pulverized material was classified using a classifier (Elbow Jet, by Nittetsu Mining Co.), thereby obtaining toner core particles with a volume average particle diameter ($D_{50}$) of 7.0 μm. The volume average particle diameter of the toner core particles was measured using a Coulter Counter Multisizer 3 (by Beckman Coulter Inc.).

Production Example 3

Production of Resin Fine Particles A 450 mL of distilled water and 0.52 g of dodecyl ammonium chloride were introduced into a 1000 mL reaction container equipped with a stirrer, a thermometer, a cooling pipe, and a nitrogen-introducing device. The temperature inside the reaction container was raised to 80° C. while stirring the content of the reaction container under nitrogen atmosphere. After raising the temperature, 120 g of an aqueous solution of potassium persulfate (polymerization initiator) with a concentration of 1% by mass and 200 g of deionized water were added to the reaction container. Next, a mixture consisting of 15 g of butyl acrylate, 165 g of methyl methacrylate, and 3.6 g of n-octyl mercaptan (chain transfer agent) was added dropwise to the reaction container over 1.5 hours followed by further allowing to polymerize over 2 hours, thereby obtaining an aqueous dispersion of resin fine particles A. The resulting aqueous dispersion of resin fine particles was dried by freeze-drying, thereby obtaining resin fine particles A. The number average particle diameter of the resin fine particles A was 102 nm. The glass transition point (Tg) of the resin fine particles A was 49.6° C. and the softening point was 188° C.

For the purpose of measuring the number average particle diameter of the resin fine particles, initially, a photograph of the resin fine particles at a magnification of 100,000 times was taken using a field emission scanning electron microscope (JSM-6700F, by JEOL Ltd.). The taken electron microscope photograph was further magnified as required and particle diameters of at least 50 resin fine particles were measured using a measuring device such as a scale and a slide gauge. The number average particle diameter of the resin fine particles was calculated from the measured values.

Production of Resin Fine Particles B to E

Resin fine particles B to E were obtained similarly to the resin fine particles A, except that the amounts of butyl acrylate and methyl methacrylate used were changed to the amounts described in Table 1. Number average particle diameters, glass transition points, and softening points of the resulting resin fine particles B to E are shown in Table 1.

TABLE 1

| Resin fine particles | A | B | C | D | E |
|---|---|---|---|---|---|
| Butyl acrylate(g) | 15 | 25 | 10 | 5 | 2 |
| Methyl methacrylate(g) | 165 | 145 | 180 | 190 | 200 |
| Glass transition point(Tg, ° C.) | 49.6 | 41.0 | 65.5 | 79.3 | 100.4 |
| Softening point(Tm, ° C.) | 188 | 191 | 190 | 185 | 187 |
| Average particle diameter(nm) | 102 | 97 | 101 | 102 | 99 |

Production of Resin Fine Particles F to I

Resin fine particles F to I were obtained similarly to the resin fine particles A, except that the amount of dodecyl ammonium chloride used was changed to the amounts described in Table 2. Number average particle diameters of the resulting resin fine particles F to I are shown in Table 2.

TABLE 2

| Resin fine particles | A | F | G | H | I |
|---|---|---|---|---|---|
| Dodecyl ammonium chloride(g) | 0.52 | 0.80 | 0.75 | 0.25 | 0.20 |
| Average particle diameter (nm) | 102 | 31 | 49 | 304 | 496 |

(Production of Resin Fine Particles J to M)

Resin fine particles J to M were obtained similarly to the resin fine particles A, except that the amount of butyl acrylate used was changed to 140 g, the amount of methyl methacrylate used was changed from 165 g to 30 g, and the amount of n-octyl mercaptan used was changed to the amounts described in Table 3.

In accordance with the method of measuring a molecular mass distribution using gel permeation chromatography (GPC) described below, molecular mass distributions of the resins constituting the resin fine particles A and J to M were measured. From the measured molecular mass distributions, mass average molecular masses (Mw) and molecular masses ($M_p$) at highest peak in molecular mass distributions of the resins constituting the resin fine particles A and J to M were determined. Mw and $M_p$ of the resins constituting the resin fine particles A and J to M are shown in Table 3. The number average particle diameters obtained for the resin fine particles J to M are also shown in Table 3.

Method of Measuring Molecular Mass Distribution 10 mg of resin fine particles were dissolved in 5 mL of tetrahydrofuran (THF) at room temperature. The resulting solution was filtered using a non-aqueous chromatodisk of opening 0.45 μm, thereby obtaining a sample solution. Using the resulting sample solution, measurement was performed under the condition below.

(Measurement Condition)

Apparatus: HLC-8220GPC (by Tosoh Co.)

Column: two of TSK-GEL Super HZM-H (by Tosoh Co.) and one of TSK guard column Super HZ-H (by Tosoh Co.)

Eluent: tetrahydrofuran (THF)

Flow rate: 0.200 mL/min

Amount of sample injected: 10 μL

Measuring temperature: 40° C.

Detector: IR detector

Calibration curve: prepared on the basis of F-380, F-128, F-40, F-10, F-4, F-1, and A-2500 selected from standard samples (TSK Standard Polystyrene, by Tosoh Co.).

TABLE 3

| Resin fine particles | A | J | K | L | M |
|---|---|---|---|---|---|
| n-octyl mercaptan(g) | 3.6 | 5.7 | 0.3 | 8.2 | 0.1 |
| Mw | 16,000 | 7,400 | 89,000 | 3,600 | 230,000 |
| $M_p$ | 15,000 | 7,100 | 86,000 | 3,800 | 230,000 |
| Average particle diameter (nm) | 102 | 108 | 107 | 105 | 101 |

(Production of Resin Fine Particles N and O)

Resin fine particles N and O were obtained similarly to the resin fine particles K except that the amount of n-octyl mercaptan used was changed to the amounts described in Table 4.

In accordance with the method below, the resins constituting the resin fine particles N and O were measured for the temperature ($T_1$) at which the melt viscosity is $1.0\times10^5$ Pa·s and the temperature ($T_2$) at which the melt viscosity is $1.0\times10^4$ Pa·s. $T_1$ and $T_2$ were also measured for the resins constituting the resin fine particles K and M. $T_1$ and $T_2$ of the resins constituting the resin fine particles K and M to O are shown in Table 4. The number average particle diameters obtained for the resin fine particles N and O are also shown in Table 4.

Measurement of $T_1$ and $T_2$ $T_1$ and $T_2$ of a resin constituting resin fine particles were measured using an elevated flow tester (CFT-500D, by Shimadzu Co.). About 1.2 g of a resin constituting resin fine particles was filled into a molding tool for preparing a measurement sample, then to which a pressure of 4 MPa was applied to thereby form a columnar pellet of the resin of diameter 1 cm and length 2 cm. The resulting pellet was set on the flow tester and measured under a measurement condition of plunger load 30 kg, die hole diameter 1 mm, die length 1 mm, preheating temperature 70° C., preheating period 300 seconds, temperature-increase rate 4° C./min, and measuring temperature range from 70° C. to 160° C.

TABLE 4

| Resin fine particles | A | K | M | N | O |
|---|---|---|---|---|---|
| n-octyl mercaptan(g) | 3.6 | 0.3 | 0.1 | 5.8 | 8.3 |
| $T_1$ (° C.) | 130 | 150 | 165 | 118 | 105 |
| $T_2$ (° C.) | 145 | 165 | 178 | 131 | 120 |
| Number average particle diameter (nm) | 102 | 107 | 101 | 108 | 105 |

Example 1

Comparative Examples 1 and 2

Preparation of Toner Base Particles

Using 10 g of the resin fine particles A obtained through Production Example 3 and 100 g of the toner core particles obtained through Production Example 2, the toner core particles were coated with the resin fine particles A and shell layers were formed on the surfaces of the toner core particles. A powder treatment device (Multi-Purpose Mixer Model MP, by Nippon Coke & Engineering Co.) was used for the shell-forming treatment. Specifically, the toner core particles and the resin fine particles A were put in a treatment bath of the powder treatment device and treated under the rotation numbers and the treatment periods described in Table 3, thereby obtaining toner base particles. In Example 1, the temperature in the bath of the powder treatment device was controlled within a range from 50° C. to 60° C.

External Addition Treatment

The resulting toner base particles were treated with titanium oxide (EC-100, by Titan Kogyo, Ltd.) of 2.0% by mass and hydrophobic silica (RA-200H, by Japan Aerosil Co.) of 1.0% by mass based on the mass of the toner base particles. The toner base particles, the titanium oxide, and the hydrophobic silica were stirred and mixed at a rotational circumferential velocity of 30 m/sec for 5 minutes using a Henschel mixer (by Nippon Coke & Engineering Co.), thereby obtaining toner.

Comparative Example 3

Using 10 g of the resin fine particles A obtained through Production Example 3 and 100 g of the toner core particles obtained through Production Example 2, the toner core particles were coated with the resin fine particles A and shell layers were formed on the surfaces of the toner core particles.

A surface modification device (device for coating fine particles, Model SFP-01, by Powrex Co.) was used for forming the shell layers. Specifically, toner particles in a toner were prepared by the method below. Initially, the toner core particles were circulated at a charge gas temperature of 80° C. in a fluid bed of the surface modification device. 300 g of an aqueous dispersion of the resin fine particles A obtained through Production Example 3, the concentration of which had been adjusted to include 10 g of the resin fine particles A, was sprayed into the fluid bed of the surface modification device at a spray speed of 5 g/min for 60 minutes, thereby obtaining toner base particles. The resulting toner base particles were subjected to externally addition treated similarly to Example 1, thereby obtaining a toner of Comparative Example 3.

Confirmation of Structure of Shell Layer

Figure 4:
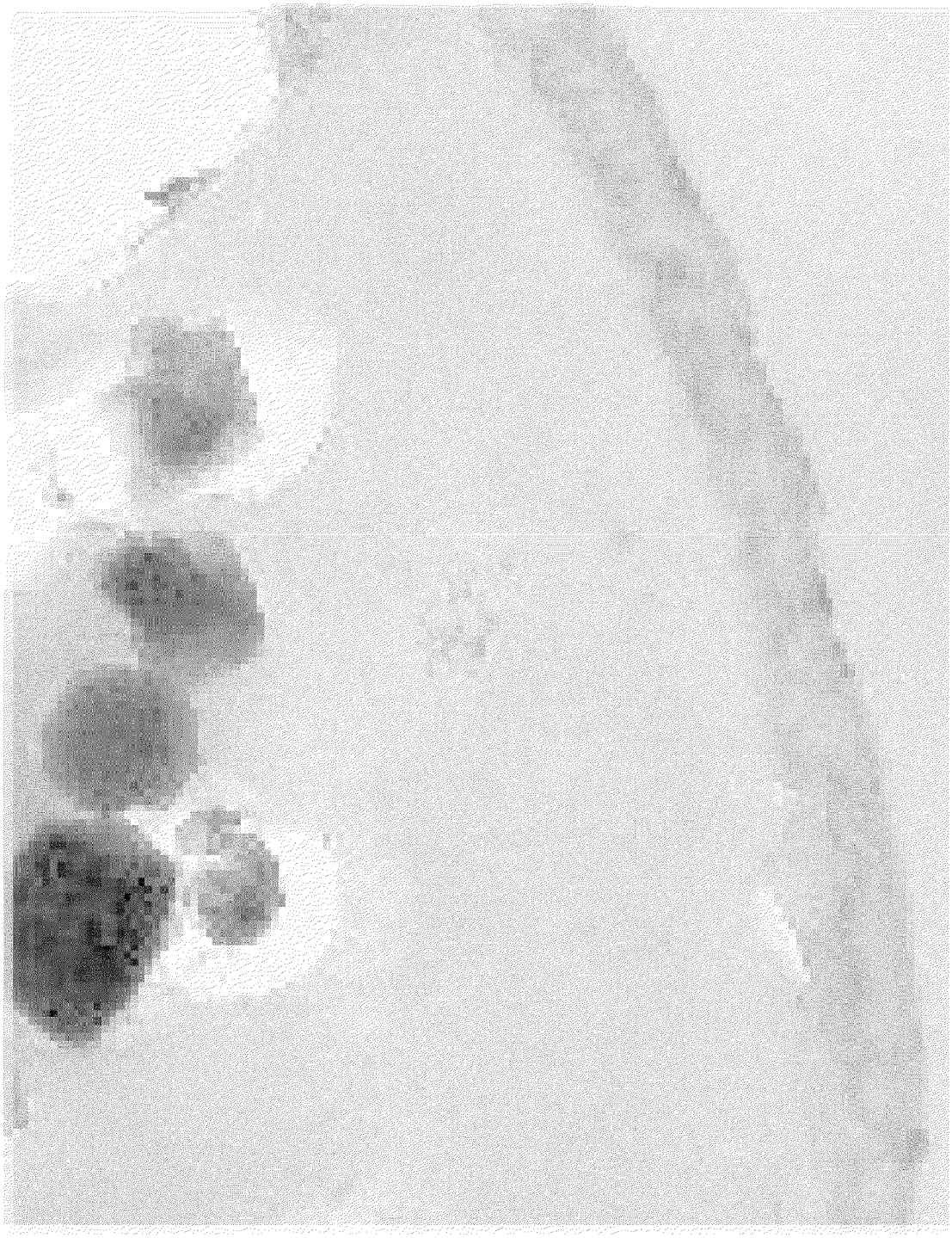
FIG. 4 is a transmission electron microscope photograph showing a cross-section of the toner particle in the toner of Example 1.
Figure 5:
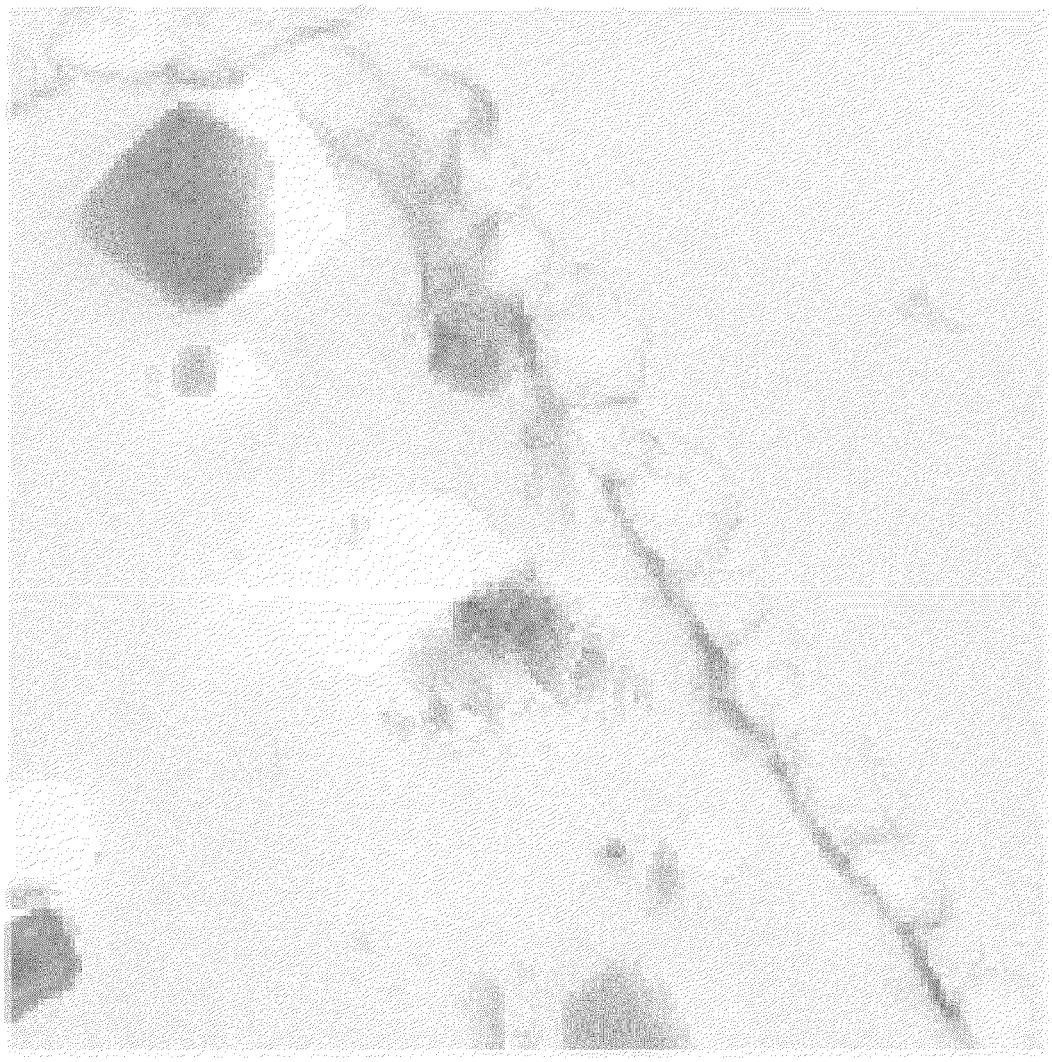
FIG. 5 is a transmission electron microscope photograph showing a cross-section of the toner particle in the toner of Comparative Example 1.
Figure 6:
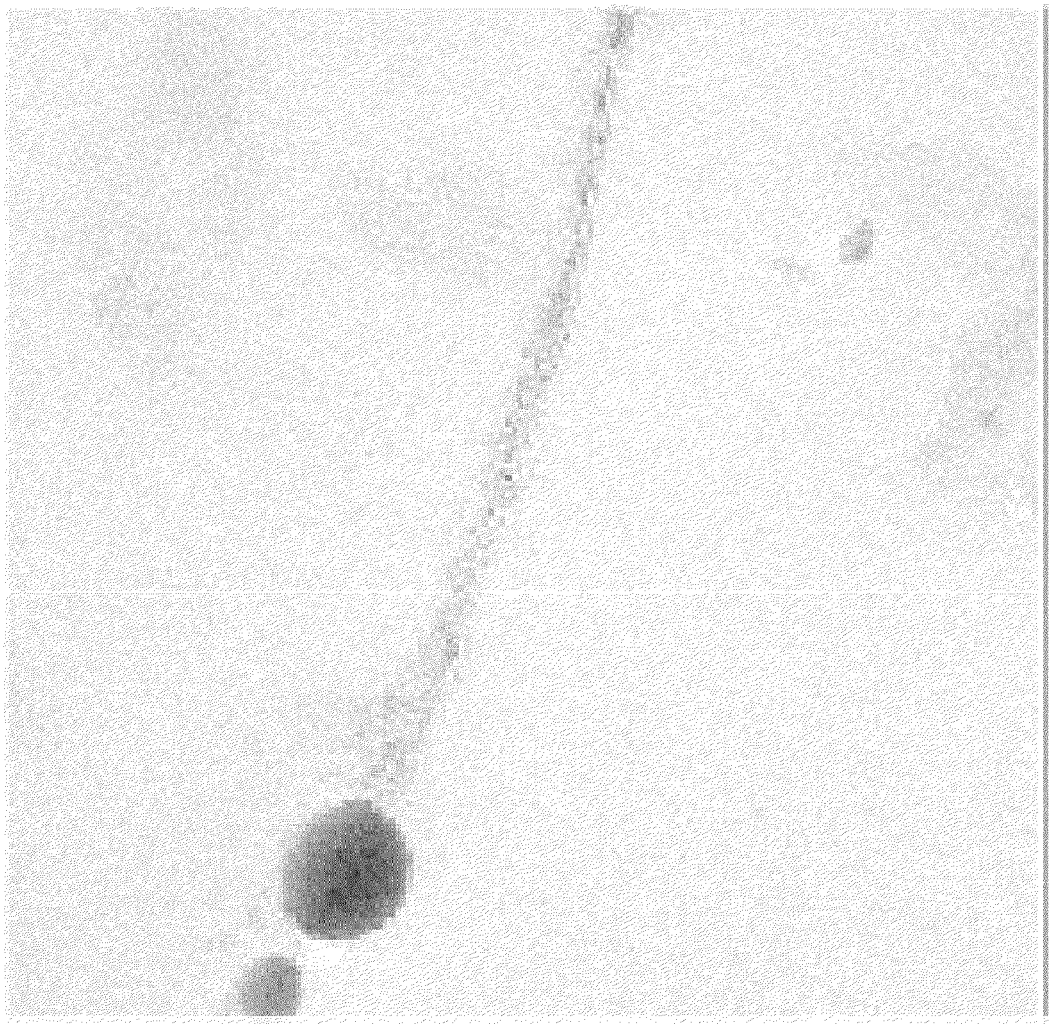
FIG. 6 is a transmission electron microscope photograph showing a cross-section of the toner particle in the toner of Comparative Example 3.

In accordance with the method below, surfaces of toner particles in the toners of Example 1 and Comparative Examples 1 to 3 were observed using a scanning electron microscope (SEM) and surface conditions of shell layers coating the toner core particles were confirmed. In accordance with the method below, photographs of cross-sections of the toner particles in the toners of Example 1 and Comparative Examples 1 to 3 were taken using a transmission electron microscope (TEM). Using the resulting TEM photographs, surface conditions of shell layers, conditions inside shell layers, and shapes of inner surfaces of shell layers were confirmed. FIG. 4 shows a TEM photograph of a cross-section of the toner particle in the toner of Example 1, FIG. 5 shows a TEM photograph of a cross-section of the toner particle in the toner of Comparative Example 1, and FIG. 6 shows a TEM photograph of a cross-section of the toner particle in the toner of Comparative Example 3.

Method of Observing Surfaces of Toner Particles

Surfaces of toner particles were observed using a scanning electron microscope (JSM-6700F, by JEOL Ltd.) at a magnification of 10,000 times.

Method of Photographing Cross-Sections of Toner Particles

A sample where toner particles of a toner were enclosed and embedded in a resin was prepared. Using a microtome (EM UC6, by Leica Co.), a thin-piece sample of 200 nm thick for observing cross-sections of the toner particles was prepared from the resulting sample. The resulting thin-piece sample was observed using a transmission electron microscope (TEM, JSM-6700F, by JEOL Ltd.) at a magnification of 50,000 times and an image of an optional cross-section of the toner particles were photographed.

In regards to the toner particles in the toner of Example 1, the structures derived from spherical resin fine particles could not be observed at the surfaces of shell layers with respect to the toner particles having a particle diameter from 6 μm to 8 μm when observing the surfaces of the toner particles using the scanning electron microscope (SEM). From the TEM photographs of cross-sections of toner particles in the toner of Example 1 as shown in FIG. 4, it was confirmed that the outer surfaces of the shell layers of the toner particles in the toner of Example 1 are smooth, cracks in a direction approximately perpendicular to the surfaces of the toner core particles exist inside the shell layers of the toner particles in the toner of Example 1, and the shell layers of the toner particles in the toner of Example 1 have convex parts at the sides of the inner surfaces between two cracks.

In regards to the toner particles in the toners of Comparative Examples 1 and 2, it was confirmed that the surfaces of toner core particles were coated with resin fine particles maintaining a spherical particle state with respect to the toner particles having a particle diameter from 6 μm to 8 μm when observing their surfaces using the SEM. From the TEM photographs of cross-sections of toner particles in the toner of Comparative Example 1 as shown in FIG. 5, it was confirmed for the toner particles in the toner of Comparative Example 1 that the surfaces of toner core particles were coated with resin fine particles maintaining a particle state. Since the structures of the shell layers of the toner particles in the toner of Comparative Example 2 was similar to the structures of the shell layers of the toner particles in the toner of Comparative Example 1 when observing the cross-sections of the toner particles in the toner of Comparative Example 2 using the TEM, no TEM photograph was taken for the cross-sections of the toner particles in the toner of Comparative Example 2.

In regards to the toner of Comparative Example 3, the structures derived from spherical resin fine particles could not be observed at the surfaces of the shell layers with respect to the toner particles having a particle diameter from 6 μm to 8 μm when observing the surface of the toner particles using the SEM. From the TEM photographs of cross-sections of the toner particles in the toner of Comparative Example 3 as shown in FIG. 6, it was confirmed that the outer surfaces of the shell layers of the toner particles in the toner of Comparative Example 3 were smooth. However, from the TEM photographs of cross-sections of the toner particles in the toner of Comparative Example 3, it could be confirmed that cracks in a direction approximately perpendicular to the surfaces of the toner core particles did not exist inside the shell layers of the toner particles in the toner of Comparative Example 3.

Evaluation

In accordance with the method below, fixability and heat-resistant storage stability of the toners of Example 1 and Comparative Examples 1 to 3 were evaluated. Evaluation results of the toners are shown in Table 5. A two-component developer, obtained in accordance with the method described in Production Example 4 shown below, was used for evaluating the fixability.

Production Example 4

Preparation of Two-Component Developer

A carrier (ferrite carrier, by Powder-Tech Co.) and a toner of 10% by mass based on the mass of the ferrite carrier were mixed using a ball mill for 30 minutes, thereby preparing a two-component developer.

Fixability

A page printer (FS-C5016N, by Kyocera Document Solutions Inc.) modified for evaluation was used as an evaluation apparatus. The evaluation apparatus was allowed to stand in a power-off state for 10 minutes and then powered up for use. Then, using a fuser roller of diameter 30 mm (driven at linear speed 100 mm/sec) and setting a fixing temperature to 180° C., an image for evaluation was obtained under an environment of normal temperature and normal humidity (20° C., 65% RH). An image density of the resulting image for evaluation before rubbing was measured using a GretagMacbeth Spectroeye (by GretagMacbeth Co.).

Then, the image for evaluation was rubbed using a 1 kg weight coated with a fabric. Specifically, the image for evaluation was rubbed by reciprocating the weight 10 times on the image for evaluation in a way that only its own weight was applied thereto. An image density of the image for evaluation after rubbing was measured using the GretagMacbeth Spectroeye (by GretagMacbeth Co.). A fixation ratio was calculated from the image densities before and after rubbing of the image for evaluation in accordance with the formula shown below. From the calculated fixation ratio, fixability was evaluated on the basis of the criteria below. Evaluation of "good" was determined to be OK.

Fixation Ratio(%)=(image density after rubbing)/(image density before rubbing)×100

Good: fixation ratio of no less than 95%;

Neutral: fixation ratio of no less than 90% and less than 95%; and

Bad: fixation ratio of less than 90%.

Heat-Resistant Storage Stability

A toner was stored at 50° C. for 100 hours. Next, the toner was screened using a sieve of 140 mesh (opening 105 μm) under a condition of rheostat scale 5 and period 30 seconds in accordance with a manual of a powder tester (by Hosokawa Micron Co.). After the screening, a mass of the toner remaining on the sieve was measured. From the mass of the toner before the screening and the mass of the toner remaining on the sieve after the screening, an agglomeration degree (%) of the toner was determined in accordance with the formula shown below. From the calculated agglomeration degree, heat-resistant storage stability was evaluated on the basis of the criteria below. Evaluation of "good" was determined to be OK.

(Formula for Calculating Agglomeration Degree)

Agglomeration Degree(%)=(mass of the toner remaining on the sieve)/(mass of the toner before the screening)×100

Good: agglomeration degree of no greater than 20%;

Neutral: agglomeration degree of greater than 20% and no greater than 50%; and

Bad: agglomeration degree of greater than 50%.

TABLE 5

| | Production conditions | | Evaluation | |
|---|---|---|---|---|
| | Rotation numbers (rpm) | Treatment period (min) | Fixability | Heat-resistant storage stability |
| Ex. 1 | 10,000 | 30 | Good | Good |
| Comp. ex. 1 | 5,000 | 10 | Good | Bad |
| Comp. ex. 2 | 7,500 | 10 | Good | Neutral |
| Comp. ex. 3 | — | — | Neutral | Good |

It is understood from Example 1 that a toner excellent in fixability and heat-resistant storage stability can be obtained when the toner comprising the toner particles containing toner core particles containing at least a binder resin and shell layers with a predetermined structure coating the entire surfaces of the toner core particles, the shell layers are formed such that the outer surfaces of the layers of the resin fine particles are smoothened to a predetermined level, and when observing the cross-sections using the transmission electron microscope, cracks in a direction approximately perpendicular to the surfaces of the toner core particles are observed inside the shell layers of the toner particles.

It is understood from Comparative Examples 1 and 2 that a toner with good heat-resistant storage stability is unlikely to be obtained when the structures derived from spherical resin fine particles are observed at the surfaces of the shell layers coating the toner core particles. The reason can be estimated that when the structures derived from spherical resin fine particles are observed at the surfaces of the shell layers, gaps remain between resin fine particles which have been somewhat deformed, thus components such as a release agent in the toner core particles tend to exude onto surfaces of the toner particles therefrom.

It was confirmed from SEM observation of the toner particles of the toners of Example 1 and Comparative Examples 1, 2 that as the rotation number of the device for forming the shell layer is increased, smoothness of the resulting surfaces of the shell layer becomes better.

It is understood from Comparative Example 3 that when cracks in a direction approximately perpendicular to the surfaces of the toner core particles are not observed inside the shell layers, fixability of the resulting toner is poor. The reason is estimated that break of the shell layers is unlikely to occur by the pressure applied at the fixing nip of the fixing unit.

Examples 2, 3

Comparative Examples 4 and 5

The toners of Examples 2, 3, Comparative Examples 4 and 5 were obtained similarly to Example 1 except that the type of the resin fine particles was changed to the types described in Table 6.

Confirmation of Structure of Shell Layer

In accordance with the above-mentioned method, surfaces of the toner particles in the toners of Examples 2, 3, Comparative Examples 4 and 5 were observed using the scanning electron microscope (SEM) and surface conditions of the shell layers coating the toner core particles were confirmed for each of the toners. In accordance with the above-mentioned method, photographs of cross-sections of the toner particles in the toners of Examples 2, 3, Comparative Examples 4 and 5 were taken using the transmission electron microscope (TEM). Using the resulting TEM photographs, surface conditions of shell layers, conditions inside shell layers, and shapes of inner surfaces of shell layers were confirmed.

In regards to the toners of Examples 2 and 3, the structures derived from spherical resin fine particles could not be observed at their shell layers with respect to the toner particles having a particle diameter from 6 μm to 8 μm when observing their surfaces of the toner particles in the toners using the scanning electron microscope (SEM). The cross-sections of the toner particles in the toners of Examples 2 and 3 were observed using the TEM; consequently, the structures of the shell layers of the toner particles in the toners of Examples 2 and 3 were similar to the structures of the shell layers of the toner particles in the toner of Example 1 as shown in the TEM photograph of FIG. 4.

In regards to the toner of Comparative Example 4, the structures derived from spherical resin fine particles could not be observed at the surfaces of the shell layers with respect to the toner particles having a particle diameter from 6 μm to 8 μm when observing the surfaces of the toner particles in the toner using the SEM. The cross-sections of the toner particles in the toner of Comparative Example 4 were observed using the TEM; consequently, the structures of the shell layers of the toner particles in the toner of Comparative Example 4 were similar to the structures of the shell layers of the toner particles in the toner of Comparative Example 3 as shown in the TEM photograph of FIG. 6.

In regards to the toner of Comparative Example 5, it was confirmed that the surfaces of toner core particles were coated with resin fine particles maintaining a spherical particle state when observing the surfaces thereof using the SEM. The cross-section of the toner particles in the toner of Comparative Example 5 was observed using the TEM; consequently, the structures of the shell layers of the toner particles in the toner of Comparative Example 5 was similar to the structures of the shell layers of the toner particles in the toner of Comparative Example 1 as shown in the TEM photograph of FIG. 5.

Evaluation

Fixability and heat-resistant storage stability of each toners of Examples 2, 3, Comparative Examples 4 and 5 were evaluated similarly to the toner of Example 1, respectively. Evaluation results of the toners are shown in Table 6.

TABLE 6

| | Resin fine particles | | Production conditions | | Evaluation | |
|---|---|---|---|---|---|---|
| | Type | Glass transition point (° C.) | Rotation numbers (rpm) | Treatment period (min) | Fixability | Heat-resistant storage stability |
| Ex. 1 | A | 49.6 | 10,000 | 30 | Good | Good |
| Ex. 2 | C | 65.5 | 10,000 | 30 | Good | Good |
| Ex. 3 | D | 79.3 | 10,000 | 30 | Good | Good |
| Comp. ex. 4 | B | 41.0 | 10,000 | 30 | Neutral | Bad |
| Comp. ex. 5 | E | 100.4 | 10,000 | 30 | Good | Neutral |

It is understood from Examples 1 to 3 and Comparative Examples 4, 5 that a toner more excellent in fixability and heat-resistant storage stability can be obtained under the same production conditions when the toner is comprised the toner particles containing toner core particles containing at least a binder resin and shell layers with a predetermined structure coating the entire surfaces of the toner core particles, the shell layers are formed such that the outer surfaces of the layers of the resin fine particles are smoothened to a predetermined level, when observing the cross-sections using the transmission electron microscope, cracks in a direction approximately perpendicular to the surfaces of the toner core particles are observed inside the shell layers of the toner particles, and when the glass transition points of the resin fine particles are from 50° C. to 80° C.

The toner particles in the toner of Comparative Example 4 were prepared using resin fine particles with a low Tg of below 50° C. Therefore, in the toner particles in the toner of Comparative Example 4, the resin fine particles were too deformed during forming the shell layers and the shell layers were formed without cracks inside thereof. It is understood from this fact that, when preparing toner particles using resin fine particles with a low Tg of below 50° C., it is necessary to adjust the conditions of production devices such that the force applied to resin fine particles and/or toner core particles is lower.

The toner particles in the toner of Comparative Example 5 were formed using resin fine particles with a high Tg of above 80° C. Therefore, in the toner particles in the toner of Comparative Example 5, the resin fine particles were not sufficiently deformed during forming the shell layers and thus the surfaces of the shell layers were not smoothened. It is understood from this fact that, when preparing toner particles using resin fine particles with a high Tg of above 80° C., it is necessary to adjust the conditions of production devices such that the force applied to resin fine particles and/or toner core particles is higher.

Examples 4 to 6

Comparative Examples 6 and 7

The toners of Examples 4 to 6 and Comparative Examples 6, 7 were obtained similarly to Example 1 except that the type and amount of the resin fine particles was changed to the types and amounts described in Table 7.

Confirmation of Structure of Shell Layer

In accordance with the above-mentioned method, surfaces of the toner particles in the toners of Examples 4 to 6 and Comparative Examples 6, 7 were observed using the scanning electron microscope (SEM) and surface conditions of the shell layers coating the toner core particles were confirmed. In accordance with the above-mentioned method, photographs of cross-sections of the toner particles in the toners of Examples 4 to 6 and Comparative Examples 6, 7 were taken using the transmission electron microscope (TEM). Using the resulting TEM photographs, surface conditions of shell layers, conditions inside shell layers, and shapes of inner surfaces of shell layers were confirmed.

In regards to the toners of Examples 4 to 6, the structures derived from spherical resin fine particles could not be observed at the surfaces of the shell layers with respect to the toner particles having a particle diameter from 6 μm to 8 μm when observing the surfaces of the toner particles in the toners using the scanning electron microscope (SEM). The cross-sections of the toner particles in the toners of Examples 4 to 6 were observed using the TEM; consequently, the structures of the shell layers of the toner particles in the toners of Examples 4 to 6 was similar to the structures of the shell layers of the toner particles in the toner of Example 1 as shown in the TEM photograph of FIG. 4.

In regards to the toner of Comparative Example 6, the structures derived from spherical resin fine particles could not be observed at the surfaces of the shell layers with respect to the toner particles having a particle diameter from 6 μm to 8 μm when observing the surfaces of the toner particles in the toner using the SEM. The cross-sections of the toner particles in the toner of Comparative Example 6 were observed using the TEM; consequently, the structures of the shell layers of the toner particles in the toner of Comparative Example 6 were similar to the structures of the shell layers of the toner particles in the toner of Comparative Example 3 as shown in the TEM photograph of FIG. 5.

In regards to the toner of Comparative Example 7, it was confirmed that the surfaces of toner core particles were coated with resin fine particles maintaining a spherical particle state when observing the surfaces thereof using the SEM. The cross-sections of the toner particles in the toner of Comparative Example 7 were observed using the TEM; consequently, the structures of the shell layers of the toner particles in the toner of Comparative Example 7 were similar to the structures of the shell layers of the toner particles in the toner of Comparative Example 1 as shown in the TEM photograph of FIG. 5.

Evaluation

Fixability and heat-resistant storage stability of each toners of Examples 4 to 6 and Comparative Examples 6, 7 were evaluated similarly to the toner of Example 1, respectively. Evaluation results of the toners are shown in Table 7.

TABLE 7

| | Resin fine particles | | | Production conditions | | Evaluation | |
|---|---|---|---|---|---|---|---|
| | Type | Average particle diameter (nm) | Amount (% by mass) | Rotation numbers (rpm) | Treatment period (min) | Fixability | Heat-resistant storage stability |
| Ex. 1 | A | 102 | 10 | 10,000 | 30 | Good | Good |
| Ex. 4 | G | 49 | 3.5 | 10,000 | 30 | Good | Good |
| Ex. 5 | A | 102 | 7.0 | 10,000 | 30 | Good | Good |
| Ex. 6 | H | 304 | 20.0 | 10,000 | 30 | Good | Good |
| Comp. ex. 6 | F | 31 | 2.0 | 10,000 | 30 | Neutral | Bad |
| Comp. ex. 7 | I | 496 | 35.0 | 10,000 | 30 | Good | Neutral |

It is understood from Examples 4 to 6 and Comparative Examples 6, 7 that a toner excellent in fixability and heat-resistant storage stability can be obtained under the same production conditions when: the toner is comprised the toner particles containing toner core particles containing at least a binder resin and shell layers with a predetermined structure coating the entire surfaces of the toner core particles, the shell layers are formed such that the outer surfaces of the layers of the resin fine particles are smoothened to a predetermined level, cracks in a direction approximately perpendicular to the surfaces of the toner core particles are observed inside the shell layers of the toner particles when observing the cross-sections using the transmission electron microscope, and the average particle diameter of the resin fine particles used for forming the shell layers is from 45 nm to 300 nm.

In Comparative Example 6, toner particles having shell layers without cracks inside thereof were formed. The reason is believed that the resin fine particles used for forming the shell layers were excessively deformed during forming the shell layers because of an excessively small average particle diameter of the resin fine particles. It is understood from this fact that, when preparing toner particles using resin fine particles with a small average particle diameter, it is necessary to adjust the conditions of production devices such that the force applied to resin fine particles and/or toner core particles becomes lower.

In Comparative Example 7, toner particles having a shell layer with non-smoothened surfaces was formed. The reason is believed that the resin fine particles used for forming the shell layers were not sufficiently deformed during forming the shell layers because of an excessively large average particle diameter of the resin fine particles. It is understood from this fact that, when preparing toner particles using resin fine particles with a large average particle diameter, it is necessary to adjust the conditions of production devices such that the force applied to resin fine particles and/or toner core particles becomes larger.

Examples 7, 8

Comparative Examples 8 and 9

The toners of Examples 7 and 8, and Comparative Examples 8 and 9 were obtained similarly to Example 1 except that the types of resin fine particles described in Table 8 were used.

Confirmation of Structure of Shell Layer

In accordance with the above-mentioned method, surfaces of the toner particles in the toners of Examples 7, 8, Comparative Examples 8 and 9 were observed using the scanning electron microscope (SEM) and surface conditions of the shell layers coating the toner core particles were confirmed for each of the toners. In accordance with the above-mentioned method, photographs of cross-sections of the toner particles in the toners of Examples 7, 8, Comparative Examples 8 and 9 were taken using the transmission electron microscope (TEM). Using the resulting TEM photographs, surface conditions of shell layers, conditions inside shell layers, and shapes of inner surfaces of shell layers were confirmed.

In regards to the toners of Examples 7 and 8, the structures derived from spherical resin fine particles could not be observed at their shell layers with respect to the toner particles having a particle diameter from 6 μm to 8 μm when observing their surfaces of the toner particles in the toners using the scanning electron microscope (SEM). The cross-sections of the toner particles in the toners of Examples 7 and 8 were observed using the TEM; consequently, the structures of the shell layers of the toner particles in the toners of Examples 7 and 8 were similar to the structures of the shell layers of the toner particles in the toner of Example 1 as shown in the TEM photograph of FIG. 4.

In regards to the toner of Comparative Example 8, the structures derived from spherical resin fine particles could not be observed at the surfaces of the shell layers with respect to the toner particles having a particle diameter from 6 μm to 8 μm when observing the surfaces of the toner particles in the toner using the SEM. The cross-sections of the toner particles in the toner of Comparative Example 8 were observed using the TEM; consequently, the structures of the shell layers of the toner particles in the toner of Comparative Example 8 was similar to the structures of the shell layers of the toner particles in the toner of Comparative Example 3 as shown in the TEM photograph of FIG. 6.

In regards to the toner of Comparative Example 9, it was confirmed that the surfaces of toner core particles were coated with resin fine particles maintaining a spherical particle state when observing the surfaces thereof using the SEM. The cross-sections of the toner particles in the toner of Comparative Example 9 were observed using the TEM; consequently, the structures of the shell layers of the toner particles in the toner of Comparative Example 9 was similar to the structures of the shell layers of the toner particles in the toner of Comparative Example 1 as shown in the TEM photograph of FIG. 5.

Evaluation

Fixability of each toners of Examples 7 and 8, and Comparative Examples 8 and 9 were evaluated similarly to the toner of Example 1, respectively. Heat-resistant storage stability of each toners of Examples 7 and 8, and Comparative Examples 8 and 9 were evaluated similarly to the toner of Example 1 except that storage temperature of the toners was changed to 50° C., respectively. Evaluation results of the toners are shown in Table 8.

TABLE 8

| | Resin fine particles | | | Production conditions | | Evaluation | |
|---|---|---|---|---|---|---|---|
| | | | | Rotation numbers | Treatment period | | Heat-resistant storage |
| | Type | Mw | $M_p$ | (rpm) | (min) | Fixability | stability |
| Ex. 7 | J | 7,400 | 7,100 | 10,000 | 30 | Good | Good |
| Ex. 8 | K | 89,000 | 86,000 | 10,000 | 30 | Good | Good |
| Comp. ex. 8 | L | 3,600 | 3,800 | 10,000 | 30 | Neutral | Bad |
| Comp. ex. 9 | M | 230,000 | 230,000 | 10,000 | 30 | Bad | Neutral |

It is understood from Examples 7 and 8, and Comparative Examples 8 and 9 that a toner more excellent in fixability and heat-resistant storage stability can be obtained under the same production conditions when: the toner particles is comprised the toner particles containing toner core particles containing at least a binder resin and a shell layers with a predetermined structure coating the entire surfaces of the toner core particles, the shell layers are formed such that the outer surfaces of the layers of the resin fine particles are smoothened to a predetermined level, cracks in a direction approximately perpendicular to the surfaces of the toner core particles are observed inside the shell layers when observing the cross-section using the transmission electron microscope, the molecular mass ($M_p$) at a maximum peak in the molecular mass distribution on a mass basis measured using gel permeation chromatography is from 5,000 to 100,000, and the shell layers are formed using resin fine particles consisting of a resin of which the mass average molecular mass (Mw) is from 5,000 to 100,000.

In Comparative Example 8, a toner containing toner particles having a shell layer without cracks inside thereof was formed. The reason is believed that the resin fine particles were excessively deformed during forming the shell layers since the shell layer was formed using resin fine particles consisting of a resin having a lower mechanical strength and excessively small Mw and $M_p$. It is understood from this fact that, when preparing a toner using resin fine particles with excessively small Mw and $M_p$, it is necessary to adjust the conditions of production devices such that the force applied to resin fine particles and/or toner core particles becomes lower.

In Comparative Example 9, a toner containing toner particles having a shell layer with a non-smoothened surface was formed. The reason is believed that the resin fine particles were not sufficiently deformed during forming the shell layers since the shell layers were formed using resin fine particles consisting of a resin having an excessively high mechanical strength and excessively high Mw and $M_p$. It is understood from this fact that, when preparing a toner using resin fine particles with excessively large Mw and $M_p$, it is necessary to adjust the conditions of production devices such that the force applied to resin fine particles and/or toner core particles becomes larger.

Example 9 and Comparative Example 10

The toners of Example 9 and Comparative Example 10 were obtained similarly to Example 1 except that the type of resin fine particles was changed to the types described in Table 9. Confirmation of Structure of Shell Layer In accordance with the above-mentioned method, surfaces of the toner particles in the toners of Example 9, and Comparative Example 10 were observed using the scanning electron microscope (SEM) and surface condition of the shell layers coating the toner core particles was confirmed for each of the toners. In accordance with the above-mentioned method, photographs of cross-sections of the toner particles in the toners of Example 9, and Comparative Example 10 were taken using the transmission electron microscope (TEM). Using the resulting TEM photographs, surface conditions of shell layers, conditions inside shell layers, and shapes of inner surfaces of shell layers were confirmed.

In regards to the toner of Example 9, the structures derived from spherical resin fine particles could not be observed at its shell layers with respect to the toner particles having a particle diameter from 6 μm to 8 μm when observing their surfaces of the toner particles in the toner using the scanning electron microscope (SEM). The cross-sections of the toner particles in the toner of Example 9 were observed using the TEM; consequently, the structures of the shell layers of the toner particles in the toner of Example 9 was similar to the structures of the shell layers of the toner particles in the toner of Example 1 as shown in the TEM photograph of FIG. 4.

In regards to the toner of Comparative Example 10, the structures derived from spherical resin fine particles could not be observed at the surfaces of the shell layers with respect to the toner particles having a particle diameter from 6 μm to 8 μm when observing the surfaces of the toner particles in the toner using the SEM. The cross-sections of the toner particles in the toner of Comparative Example 10 were observed using the TEM; consequently, the structures of the shell layers of the toner particles in the toner of Comparative Example 10 was similar to the structures of the shell layers of the toner particles in the toner of Comparative Example 3 as shown in the TEM photograph of FIG. 6.

Evaluation

Fixability of each toners of Example 9 and Comparative Example 10 was evaluated similarly to the toner of Example 1, respectively. Furthermore, heat-resistant storage stability of each toners of Example 9 and Comparative Example 10 was evaluated similarly to the toner of Example 1 except that storage temperature of the toners was changed to 45° C., respectively. Evaluation results of the toners are shown in Table 9.

TABLE 9

| | Resin fine particles | | | Production conditions | | Evaluation | |
|---|---|---|---|---|---|---|---|
| | Type | $T_1$ (° C.) | $T_2$ (° C.) | Rotation numbers (rpm) | Treatment period (min) | Fixability | Heat-resistant storage stability |
| Ex. 1 | A | 130 | 145 | 10,000 | 30 | Good | Good |
| Ex. 8 | K | 150 | 165 | 10,000 | 30 | Good | Good |
| Comp. ex. 9 | M | 165 | 178 | 10,000 | 30 | Neutral | Neutral |
| Ex. 9 | N | 118 | 132 | 10,000 | 30 | Good | Good |
| Comp. ex. 10 | O | 105 | 120 | 10,000 | 30 | Neutral | Bad |

By comparison of Examples 1, 8 and 9, and Comparative Examples 9 and 10, it is understood that, when coating the toner core particles using the resin fine particles consisting of a resin in which the temperature ($T_1$) at a melt viscosity of $1.0\times10^5$ Pa·s is from 110° C. to 160° C. and the temperature ($T_2$) at a melt viscosity of $1.0\times10^4$ Pa·s is from 130° C. to 170° C., a toner including toner particles, where cracks in a direction approximately perpendicular to the surfaces of the toner core particles are observed inside the shell layers when observing the cross-section using the transmission electron microscope, may be easily obtained. Toners which include toner particles having a shell layer with such a structure are excellent in fixability and heat-resistant storage stability.

In Comparative Example 10, toner particles having shell layers without cracks inside thereof were formed. The reason is believed that the resin fine particles were excessively deformed during forming the shell layers since the shell layers were formed using resin fine particles consisting of a resin that has a lower mechanical strength and lower $T_1$ and $T_2$ and thus is likely to soften even at low temperatures. It is understood from this fact that, when preparing toner particles using resin fine particles with excessively low $T_1$ and $T_2$, it is necessary to adjust the conditions of production devices such that the force applied to resin fine particles and/or toner core particles becomes lower.

As described above, in Comparative Example 9, a toner which includes toner particles having a shell layer with a non-smoothened surface was formed. The resin constituting the resin fine particles M used for forming the shell layers in Comparative Example 9 is unlikely to soften at other than high temperatures because of not only excessively large Mw and $M_p$ but also high $T_1$ and $T_2$. It is therefore believed in Comparative Example 9 that the resin fine particles were not sufficiently deformed during forming the shell layers. It is understood from this fact that, when preparing toner particles using resin fine particles with excessively high $T_1$ and $T_2$, it is necessary to adjust the conditions of production devices such that the force applied to resin fine particles and/or toner core particles becomes larger.

Production Example 5

Toner core particles A to E were produced by the procedures below.

(Production of Toner Core Particles A to C)

89 parts by mass of a binder resin (the polyester resin obtained through Production Example 1), 5 parts by mass of a release agent (polypropylene wax 660P, by Sanyo Chemical Industries, Ltd.), 1 part by mass of a charge control agent (P-51, by Orient Chemical Industries Co.), and 5 parts by mass of a colorant (carbon black MA100, by Mitsubishi Chemical Co.) were mixed using a mixer, thereby obtaining a mixture. Next, the mixture was melted and kneaded using a twin screw extruder, thereby obtaining a kneaded material. The kneaded material was coarsely pulverized using a pulverizing device (ROTOPLEX, by Toakikai Co.), thereby obtaining a coarsely pulverized material with a volume average particle diameter ($D_{50}$) of about 20 μm. The resulting coarsely pulverized material was finely pulverized using a mechanical pulverizing device (Turbo mill, by Turbo Industries, Co.) by the number of divided stages described in Table 10, thereby obtaining finely pulverized materials. The resulting finely pulverized materials were classified using a classifier (Elbow Jet, by Nittetsu Mining Co.), thereby obtaining toner core particles A to C with volume average particle diameters ($D_{50}$) described in Table 10. The volume average particle diameter of the toner core particles was measured using a Coulter Counter Multisizer 3 (by Beckman Coulter Inc.).

(Production of Toner Core Particles D)

Toner core particles D with a volume average particle diameter ($D_{50}$) of 7.0 μm were obtained similarly to the toner core particles A except that the coarsely pulverized material was finely pulverized using a collision type pulverizing device (jet mill pulverizing device, by Nippon Pneumatic Mfg. Co.) in place of the mechanical pulverizing device.

(Production of Toner Core Particles E)

The toner core particles A were further heat-treated at 280° C. using a heat-treatment device (SUFFUSION, by Nippon Pneumatic Mfg. Co.), thereby obtaining toner core particles E with a volume average particle diameter ($D_{50}$) of 7.05 μm.

TABLE 10

| Toner core particles | A | B | C | D | E |
|---|---|---|---|---|---|
| Number of divided stage(s) of pulverization | 3 | 2 | 1 | 3(*) | 3 |
| Heat treatment temperature(° C.) | — | — | — | — | 280 |
| Average particle diameter (μm) | 7.00 | 7.09 | 7.02 | 7.03 | 7.05 |

(*)The number of pulverizing treatment stages of the toner core particles D is the number of pulverizing treatment stages by the collision type pulverizing device.

Examples 10 to 14

(Preparation of Toner Base Particles)

Toners of Examples 10 to 14 were obtained similarly to Example 1 except that the types of toner core particles described in Table 11 were used.

Average circularities of the toners of Examples 10 to 14 were measured in accordance with the method below. The average circularities of the toners of Examples 10 to 14 are shown in Table 11.

Method of Measuring Average Circularity

Using a Flow Particle Image Analyzer (FPIA-3000, by Sysmex Co.), an average circularity of toner particles with a particle diameter from 3 μm to 10 μm in a toner was measured. Under an environment of 23° C. and 60% RH, a circumferential length ($L_0$) of a circle having a projected area the same as that of a particle image and a peripheral length (L) of a particle projected image were measured for all of toner particles. A circularity was calculated from the measured $L_0$ and L in accordance with the formula below. The sum of circularities of toner particles with an equivalent circle diameter from 3.0 μm to 10.0 μm was divided by a total particle number of toner particles with an equivalent circle diameter from 3.0 μm to 10.0 μm, and the resulting value was defined as the average circularity.

(Formula to Calculate Average Circularity)

$$\text{Average circularity}=L_0/L$$

Evaluation

In accordance with the methods below, each toners of Examples 10 to 14 were evaluated with respect to transfer property and cleaning ability in addition to the fixability and the heat-resistant storage stability described above, respectively. Evaluation results of the toners are shown in Table 11. A page printer (FS-C5016N, by Kyocera Document Solutions Inc.) modified to allow temperature control for the evaluation and equipped with a cleaning unit having an elastic blade was used as an evaluation apparatus for evaluating the transfer property and the cleaning ability, and an image for evaluation was obtained with setting a fixing temperature to 180° C. under an environment of 20° C. and 65% RH. The evaluation apparatus was allowed to stand in a power-off state for 10 minutes and then powered up for use. A two-component developer, obtained in accordance with the preparation method of Production Example 4 described above, was used for evaluating the transfer property and the cleaning ability.

Transfer Property

Using the evaluation apparatus, a thin-line image was formed as an initial image. A transfer efficiency of the formed thin-line image was calculated in accordance with the method below. Existence or nonexistence of void on the thin-line image was observed using a loupe. Occurrence of letter scattering on the thin-line image was observed using the loupe and with the unaided eye. The transfer property was evaluated in accordance with the criteria below. Evaluation of "good" was determined to be OK.

(Formula for Calculating Transfer Efficiency)

The transfer efficiency was calculated by measuring an amount of toner consumed in a development device (amount of consumed toner) and an amount of discarded toner collected at a cleaning unit and using the formula below.

$$\text{Transfer efficiency}(\%)=((\text{amount of consumed toner})-(\text{amount of discarded toner}))/(\text{amount of consumed toner})\times 100$$

Good: transfer efficiency was no less than 90% and void or letter scattering could not be confirmed;

Neutral: transfer efficiency was no less than 90%, but void and/or letter scattering could be confirmed; and Bad: transfer efficiency was less than 90%.

Cleaning Ability

An image of white paper was formed immediately after forming a solid image using the evaluation apparatus. Occurrence of black streak due to passing through of toner at the cleaning unit was visually confirmed in the image of white paper. The cleaning ability was evaluated in accordance with the criteria below. Evaluation of "good" was determined to be OK.

Good: no black streak due to passing through of toner could be confirmed in the image of white paper;

Neutral: black streaks due to passing through of toner could be slightly confirmed in the image of white paper; and Bad: many black streaks due to passing through of toner could be confirmed in the image of white paper.

TABLE 11

| | Ex. 10 | Ex. 11 | Ex. 12 | Ex. 13 | Ex. 14 |
|---|---|---|---|---|---|
| Type of toner core particle | A | B | C | D | E |
| Production conditions | | | | | |
| Rotation numbers (rpm) | 10,000 | 10,000 | 10,000 | 10,000 | 10,000 |
| Treatment period (min) | 30 | 30 | 30 | 30 | 30 |
| Average circularity | 0.967 | 0.962 | 0.955 | 0.942 | 0.981 |
| Evaluation | | | | | |
| Fixability | Good | Good | Good | Good | Good |
| Heat-resistant storage stability | Good | Good | Good | Good | Good |
| Transfer property | Good | Good | Neutral | Bad | Good |
| Cleaning ability | Good | Good | Good | Good | Bad |

In regards to toner particles in the toners of Examples 10 to 14 where their shell layers were formed under the same conditions as that of Example 1, it is understood respectively that the structures derived from the spherical resin fine particles were unobservable at the surfaces of the shell layers, the outer surfaces were smooth, and the shell layers having cracks with a predetermined configuration inside the layers were formed.

It is understood from Examples 10 to 14 that fixability and heat-resistant storage stability are excellent in a toner when: the toner is comprised the toner particles containing toner core particles containing at least a binder resin and shell layers coating the entire surfaces of the toner core particles, the outer surface of the shell layers are smooth, and cracks in a direction approximately perpendicular to the surfaces of the toner core particles are observed inside the shell layers when observing the cross-sections of the toner particles using the transmission electron microscope.

By comparison of Example 10, Example 11, and Examples 12 to 14, it is understood that when forming images using a toner in which the average circularity of toner particles with a particle diameter from 3 μm to 10 μm is from 0.960 to 0.970, image defects due to passing through of the toner in cleaning units and occurrence of image defects such as void and letter scattering due to transfer failure in resulting images can be suppressed.

The invention claimed is:

1. A toner for electrostatic latent image development including a plurality of toner particles, each of the plurality of toner particles comprising a toner core particle containing at least a binder resin and a shell layer coating the toner core particle, wherein:

the shell layer comprises spherical resin fine particles adhere to an entire surface of the toner core particle such that the spherical resin fine particles do not overlap in a direction perpendicular to the surface of the toner core particle, a surface of the shell layer of the toner core particle, which is not contacting toner core particle, is flattened such that an original shape of the spherical resin fine particles do not remain among the toner particles having a particle diameter from 6 μm to 8 μm, and the shell layer further comprises cracks on a surface which is contacting toner core particle, the cracks are approximately perpendicular to surface of the toner core particle and originate at phase boundaries of the resin fine particles themselves.

2. The toner for electrostatic latent image development according to claim 1, wherein an average circularity of the plurality of toner particles with a particle diameter from 3 μm to 10 μm is from 0.960 to 0.970.

3. The toner for electrostatic latent image development according to claim 1, wherein a thickness of the shell layer is from 0.045 μm to 0.3 μm.

4. The toner for electrostatic latent image development according to claim 1, wherein when a cross-section of each of the plurality of the toner particles is observed using a transmission electron microscope, a convex part, between two of the cracks, of the shell layer is observable on a phase boundary between the toner core particle and the shell layer.

5. The toner for electrostatic latent image development according to claim 1, wherein a molecular mass (Mp) at a maximum peak in molecular mass distribution on a mass basis, measured using gel permeation chromatography, of a resin constituting the resin fine particles is from 5,000 to 100,000, and a mass average molecular mass (Mw) of the resin constituting the resin fine particles is from 5,000 to 100,000.

6. The toner for electrostatic latent image development according to claim 1, wherein a temperature (T1) at a melt viscosity of $1.0\times10^5$ Pa·s is from 110° C. to 160° C. and a temperature (T2) at a melt viscosity of $1.0\times10^4$ Pa·s is from 130° C. to 170° C. in the resin constituting the resin fine particles.

7. The toner for electrostatic latent image development according to claim 1, wherein the shell layer is formed using a method comprising the steps of I) and II) below:

I) a step of making spherical resin fine particles adhere to the surface of the toner core particle so as to not overlap thereon in a direction perpendicular to the surface of the toner core particle and forming a layer of the resin fine particles that covers the entire surface of the toner core particle, and II) a step of smoothening the outer surface of the layer of the resin fine particle to thereby form the shell layer by applying an external force to the outer surface of the layer of the resin fine particles and deforming the resin fine particles in the layer of the resin fine particles.

* * * * *